US008725499B2

(12) United States Patent
Rajendran et al.

(10) Patent No.: US 8,725,499 B2
(45) Date of Patent: May 13, 2014

(54) SYSTEMS, METHODS, AND APPARATUS FOR SIGNAL CHANGE DETECTION

(75) Inventors: Vivek Rajendran, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1166 days.

(21) Appl. No.: 11/830,548

(22) Filed: Jul. 30, 2007

(65) Prior Publication Data

US 2008/0027716 A1 Jan. 31, 2008

Related U.S. Application Data

(60) Provisional application No. 60/834,689, filed on Jul. 31, 2006.

(51) Int. Cl.
*G10L 11/06* (2006.01)

(52) U.S. Cl.
USPC ..... 704/210

(58) Field of Classification Search
CPC ..... G10L 25/78; G10L 19/012
USPC ..... 704/210, 220, 221, 223
See application file for complete search history.

(56) References Cited

U.S. PATENT DOCUMENTS 5,341,456 A * 8/1994 DeJaco ..... 704/214
5,504,773 A 4/1996 Padovani et al.
5,704,003 A 12/1997 Kleijn et al.
5,937,375 A * 8/1999 Nakamura ..... 704/215
6,330,532 B1 12/2001 Manjunath et al.
6,415,252 B1 * 7/2002 Peng et al. ..... 704/208
6,475,245 B2 * 11/2002 Gersho et al. ..... 704/208
6,606,593 B1 * 8/2003 Jarvinen et al. ..... 704/223
6,691,084 B2 2/2004 Manjunath et al.
6,807,525 B1 10/2004 Li et al.
6,879,955 B2 4/2005 Rao
6,889,186 B1 * 5/2005 Michaelis ..... 704/225
7,013,269 B1 * 3/2006 Bhaskar et al. ..... 704/219
7,231,348 B1 * 6/2007 Gao et al. ..... 704/233
7,577,567 B2 * 8/2009 Ehara ..... 704/223

(Continued)

FOREIGN PATENT DOCUMENTS

EP 1061506 A2 12/2000
EP 1229520 8/2002

(Continued)

OTHER PUBLICATIONS

3rd Generation Partnership Project 2 ("3GPP2"), Enhanced Variable Rate Codec, Speech Service Option 3 and 68 for Wideband Spread Spectrum Digital Systems, 3GPP2 C.S0014-B, ver. 1.0, May 2006.

(Continued)

*Primary Examiner* — Jakieda Jackson
(74) *Attorney, Agent, or Firm* — Heejong Yoo

(57) ABSTRACT

Disclosed configurations include systems, methods, and apparatus arranged to generate a sequence of spectral tilt values that is based on inactive frames of a speech signal. For each of a plurality of inactive frames of the speech signal, a transmit decision is made according to a change calculated among at least two corresponding values of the sequence. The outcome of the transmit decision determines whether a silence description is transmitted for the corresponding inactive frame.

46 Claims, 18 Drawing Sheets

(56) References Cited

U.S. PATENT DOCUMENTS

| | | | | |
|---|---|---|---|---|
| 2001/0008995 | A1* | 7/2001 | Kim et al. | 704/223 |
| 2004/0098255 | A1 | 5/2004 | Kovesi et al. | |
| 2006/0171419 | A1 | 8/2006 | Spindola et al. | |
| 2006/0271356 | A1 | 11/2006 | Vos | |
| 2006/0277038 | A1 | 12/2006 | Vos et al. | |
| 2006/0277042 | A1 | 12/2006 | Vos et al. | |
| 2006/0282262 | A1 | 12/2006 | Vos et al. | |
| 2006/0282263 | A1 | 12/2006 | Vos et al. | |
| 2007/0088541 | A1 | 4/2007 | Vos et al. | |
| 2007/0088542 | A1 | 4/2007 | Vos et al. | |
| 2007/0088558 | A1 | 4/2007 | Vos et al. | |
| 2007/0094017 | A1* | 4/2007 | Zinser et al. | 704/219 |
| 2007/0171931 | A1 | 7/2007 | Manjunath et al. | |
| 2008/0294429 | A1* | 11/2008 | Su et al. | 704/222 |

FOREIGN PATENT DOCUMENTS

| | | | |
|---|---|---|---|
| EP | 1533791 | A2 | 5/2005 |
| JP | 2002237785 | A | 8/2002 |
| JP | 2006502426 | A | 1/2006 |
| JP | 2006502427 | A | 1/2006 |
| WO | 9944191 | | 9/1999 |
| WO | 2000030075 | A1 | 5/2000 |
| WO | 2004034376 | | 4/2004 |
| WO | 2006107837 | A1 | 10/2006 |

OTHER PUBLICATIONS

3rd Generation Partnership Project 2 ("3GPP2"), Enhanced Variable Rate Codec, Speech Service Options 3, 68, and 70 for Wideband Spread Spectrum Digital Systems, 3GPP2 C.S0014-C, ver. 1.0, Jan. 2007.

European Telecommunications Standards Institute (ETSI) 3rd Generation Partnership Project (3GPP), Digital cellular telecommunications system (Phase 2+), Universal Mobile Telecommunications System (UMTS), AMR speech Codec, comfort noise for AMR Speech Traffic Channels, ETSI TS 126.092, ver. 6.0.0 (3GPP TS 26.092 version 6.0.0 Release 6), Dec. 2004.

European Telecommunications Standards Institute (ETSI) 3rd Generation Partnership Project (3GPP), Digital cellular telecommunications system (Phase 2+), Universal Mobile Telecommunications System (UMTS), Mandatory Speech Codec speech processing functions AMR Wideband Speech Codec, Comfort noise aspects, ETSI TS 126 192, ver.6.0.0 (3GPP TS 26.192 version 6.0.0 Release 6), Dec. 2004.

European Telecommunications Standards Institute (ETSI) 3rd Generation Partnership Project (3GPP), Digital cellular telecommunications system (Phase 2+), Full rate speech, Transcoding, ETSI EN 300 961, ver. 8.1.1 (GSM 06.10 version 8.1.1 Release 1999), Nov. 2000.

European Telecommunications Standards Institute (ETSI) 3rd Generation Partnership Project (3GPP), Digital cellular telecommunications system (Phase 2+), Enhanced Full Rate (EFR) speech transcoding, ETSI EN 300 726, ver. 8.0.1 (GSM 06.60, ver. 8.0.1, Release 1999), Nov. 2000.

International Telecommunications Union, Telecommunication Standardization Sector of ITU ("ITU-T"), Series G: Transmission Systems and Media, Digital Systems and Networks, Digital transmission systems—Terminal equipments—Coding of analogue signals by methods other than PCM, Coding of speech at 8 kbit/s using Conjugate-Structure Algebraic-Code-Excited Linear-Prediction (CS-ACELP), Annex E: 11.8 kbit/s CS-ACELP speech coding algorithm ("G.729 Annex E"), Sep. 1998.

International Telecommunications Union, Telecommunication Standardization Sector of ITU ("ITU-T"), Series G: Transmission Systems and Media, Digital Systems and Networks, Digital terminal equipments—Coding of analogue signals by methods other than PCM, Wideband coding of speech at around 16 kbit/s using Adaptive Multi-Rate Wideband (AMR-WB), (ITU-T Recommendation "G.722.2"), Jul. 2003

International Telecommunications Union, Telecommunication Standardization Sector of ITU ("ITU-T"), Series G: Transmission Systems and Media, Digital Systems and Networks, Digital transmission systems—Terminal equipments—Coding of analogue signals by methods other than PCM, Coding of speech at 8 kbit/s using conjugate structure algebraic-code-excited linear-prediction (CS-ACELP), Annex B: A silence compression scheme for G.729 optimized for terminals conforming to Recommendation V.70 ("G.729 Annex B"), Nov. 1996.

Telecommunications Industry Association, TIA/EIA Interim Standard, Enhanced Variable Rate Code, Speech Service Option 3 for Wideband Spread Spectrum Digital Systems, TIA-EIA-IS-127, Telecommunications Industry Association and Electronic Industries Association, Jan. 1997.

Telecommunications Industry Association, TIA Standard, Enhanced Variable Rate Codec Speech Option 3 for Wideband Spread Spectrum Digital Systems, TIA-127-A (Revision of TIA/EIA/IS-127), Telecommunications Industry Association, May 2004.

Telecommunications Industry Association, TIA Standard, Enhanced Variable Rate Codec Speech Service Option 3 and YY for Wideband Spread Spectrum Digital Systems, TIA-127-B (Revision of TIA-127-A), Telecommunications Industry Association, Dec. 2006.

Telecommunications Industry Association, TIA/EIA Interim Standard, TDMA Cellular/PCS—Radio Interface—Enhanced Full-Rate Speech Codec, TIA/EIA/IS-641, Telecommunications Industry Association, May 1996.

Telecommunications Industry Association, TR45, TIA/EIA IS-641-A, TDMA CelluladPCS—Radio Interface, Enhanced Full-Rate Voice Codec, Revision A, Telecommunications Industry Association, Sep. 1997.

International Preliminary Report on Patentabiiity—PCT/US07/074895, International Preliminary Examining Authority—European Patent Office, Dec. 1, 2008.

Written Opinion—PCT/US07/074895, International Search Authority—European Patent Office, Jan. 16, 2008.

International Search Report—PCT/US07/074895. International Search Authority—European Patent Office, Jan. 16, 2008.

Freeman D.K. et al, "The voice activity detector for the Pan-European digital cellular mobile telephone service." International Conference on Acoustics, Speech and Signal Processing. May 23, 1989, pp. 369-372. XP010083078.

Taiwan Search Report—TW096128125—TIPO—Apr. 4, 2003.

Taiwan Search Report—TW096128125—TIPO—Aug. 30, 2011.

* cited by examiner

```
p = FALSE;

/* Part 1: task T300 */
y_past = y_current;
y_current = 0.2*k0 + 0.8*y_past;

/* Part 2: task T400 */
z = y_current - y_past;

/* Part 3: task T500 */
if (z > 0.2) p = TRUE;
```

FIG. 8A

```
p = FALSE;

/* Part 1: task T310 */
if (!Y_VALID) y_current = k0;
Y_VALID = TRUE;
y_past = y_current;
y_current = 0.2*k0 + 0.8*y_past;

/* Part 2: task T400 */
z = y_current - y_past;

/* Part 3: task T500 */
if (z > 0.2) p = TRUE;
```

FIG. 8B

```
p = FALSE;

/* Part 1: task T312 */
if (FRAME_ACTIVE)
  { hangover_1 = 5; exit(); }
if (hangover_1 > 0)
  { hangover_1--; exit(); }
if (!Y_VALID) y_current = k0;
Y_VALID = TRUE;
y_past = y_current;
y_current = 0.2*k0 + 0.8*y_past;

/* Part 2: task T400 */
z = y_current - y_past;

/* Part 3: task T500 */
if (z > 0.2) p = TRUE;
```

```
p = FALSE;

/* Part 1: task T332 */
if (FRAME_ACTIVE) { hangover_1 = 5; exit(); }
if (hangover_1 > 0) { hangover_1--; exit(); }
if (!Y_VALID) { Gc_current = Gc; y_current = k0; }
Y_VALID = TRUE;
Gc_past = Gc_current;
Gc_current = Gc;
Gc_diff = abs(Gc_current - Gc_past);
if (Gc_diff > 0.72) hangover_2 = 2;
if (hangover_2 > 0) { hangover_2--; exit(); }
y_past = y_current;
y_current = 0.2*k0 + 0.8*y_past;

/* Part 2: task T400 */
z = y_current - y_past;

/* Part 3: task T510 */
if (z > 0.2 && Gc_diff < 0.65) p = TRUE;
```

FIG. 21

SYSTEMS, METHODS, AND APPARATUS FOR SIGNAL CHANGE DETECTION

RELATED APPLICATIONS

This application claims benefit of U.S. Provisional Pat. Application No. 60/834,689, entitled "SPECTRAL TILT BASED DTX SCHEME," filed Jul. 31, 2006.

FIELD

This disclosure relates to signal processing.

BACKGROUND

Transmission of voice by digital techniques has become widespread, particularly in long distance telephony, packet-switched telephony such as Voice over IP (VoIP), and digital radio telephony such as cellular telephony. Such proliferation has created interest in reducing the amount of information used to transfer a voice communication over a transmission channel while maintaining the perceived quality of the reconstructed speech.

Devices that are configured to compress speech by extracting parameters that relate to a model of human speech generation are called "speech coders." A speech coder generally includes an encoder and a decoder. The encoder typically divides the incoming speech signal (a digital signal representing audio information) into segments of time called "frames," analyzes each frame to extract certain relevant parameters, and quantizes the parameters into a binary representation, such as a set of bits or a binary data packet. The data packets are transmitted over a transmission channel (i.e., a wired or wireless network connection) to a receiver that includes a decoder. The decoder receives and processes data packets, dequantizes them to produce the parameters, and recreates speech frames using the dequantized parameters.

In a typical conversation, each speaker is silent for about sixty percent of the time. Speech encoders are usually configured to distinguish frames of the speech signal that contain speech ("active frames") from frames of the speech signal that contain only silence or background noise ("inactive frames"). Such an encoder may be configured to use different coding modes and/or rates to encode active and inactive frames. For example, speech encoders are typically configured to transmit encoded inactive frames (also called "silence descriptors," "silence descriptions," or SIDs) at a lower bit rate than encoded active frames.

At any time during a full duplex telephonic communication, it may be expected that the input to at least one of the speech encoders will be an inactive frame. It may be desirable for an encoder to transmit SIDs for fewer than all of the inactive frames. Such operation is also called discontinuous transmission (DTX). In one example, a speech encoder performs DTX by transmitting one SID for each string of 32 consecutive inactive frames. The corresponding decoder applies information in the SID to update a noise generation model that is used by a comfort noise generation algorithm to synthesize inactive frames.

SUMMARY

A method of processing a speech signal according to a configuration includes generating a sequence of spectral tilt values that is based on a plurality of inactive frames of the speech signal. This method includes calculating a change among at least two values of the sequence of spectral tilt values and, for an inactive frame among the plurality of inactive frames, deciding whether to transmit a description for the frame. In this method, deciding whether to transmit a description for the frame is based on the calculated change.

A computer program product according to another configuration includes a computer-readable medium. This medium includes code for causing at least one computer to generate a sequence of spectral tilt values that is based on a plurality of inactive frames of the speech signal. This medium includes code for causing at least one computer to calculate a change among at least two values of the sequence of spectral tilt values; and code for causing at least one computer to decide, for an inactive frame among the plurality of inactive frames, and based on the calculated change, whether to transmit a description for the frame.

An apparatus for processing a speech signal according to another configuration includes a sequence generator configured to generate a sequence of spectral tilt values that is based on a plurality of inactive frames of the speech signal. This apparatus includes a calculator configured to calculate a change among at least two values of the sequence of spectral tilt values; and a comparator configured to decide, for an inactive frame among the plurality of inactive frames, and based on the calculated change, whether to transmit a description for the frame.

An apparatus for processing a speech signal according to another configuration includes means for generating a sequence of spectral tilt values that is based on a plurality of inactive frames of the speech signal. This apparatus includes means for calculating a change among at least two values of the sequence of spectral tilt values; and means for deciding, for an inactive frame among the plurality of inactive frames, and based on the calculated change, whether to transmit a description for the frame.

BRIEF DESCRIPTION OF THE DRAWINGS

FIG. 8A shows a source code listing for a set of instructions that may be executed to perform an implementation of method M100.

FIG. 8B shows a source code listing for a set of instructions that may be executed to perform another implementation of method M100.

FIG. 1A shows a flowchart of an implementation M200 of method M100.

FIG. 1B shows a flowchart of an implementation A200 of apparatus A100.

FIG. 21 shows a source code listing for a set of instructions that may be executed to perform a further implementation of method M100.

DETAILED DESCRIPTION

Figure 1A:
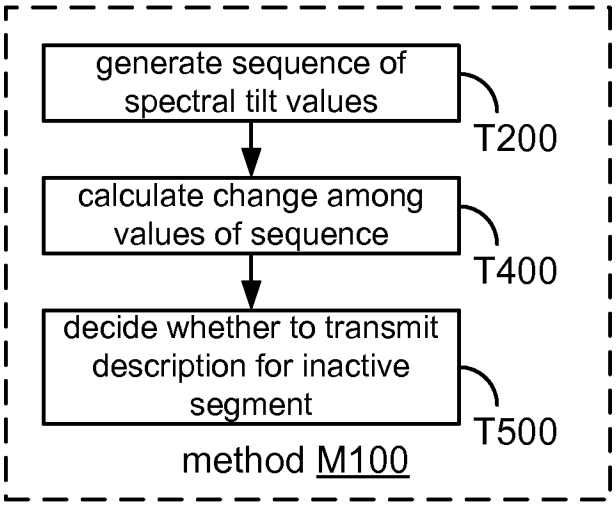
FIG. 1A shows a flowchart of a method M100 according to a configuration.

Configurations described herein include systems, methods, and apparatus for detecting a change in a speech signal. For example, configurations are disclosed for detecting a change during an inactive period of the signal and, based on such detection, initiating an update to a description of the signal. These configurations are typically intended for use in packet-switched networks (for example, wired and/or wireless networks arranged to carry voice transmissions according to protocols such as Voice over IP or VoIP), although use in circuit-switched networks is also expressly contemplated and hereby disclosed.

Unless expressly limited by its context, the term "calculating" is used herein to indicate any of its ordinary meanings, such as computing, evaluating, smoothing, and selecting from a plurality of values. Where the term "comprising" is used in the present description and claims, it does not exclude other elements or operations. The term "A is based on B" is used to indicate any of its ordinary meanings, including the cases (i) "A based on at least B" and (ii) "A is equal to B" (if appropriate in the particular context).

An encoder practicing DTX may be configured to drop (or "blank") most inactive frames according to a blanking scheme. One example of a blanking scheme issues updates to the silence description at regular intervals (for example, once every $16^{th}$ or $32^{nd}$ consecutive inactive frame). Other blanking schemes (also called "smart blanking" schemes) are configured to issue updates to the silence description upon detecting fluctuations in energy and/or spectral characteristics that may indicate changes in the background noise.

A blanking scheme that relies only on fluctuations in energy may sometimes fail to detect perceptually significant changes in the background noise. In some cases, inactive frames that are perceptually different will have similar energy characteristics (typically encoded as gain values). Although background noise in a street ("street noise") may have an energy distribution over time that is similar to that of background noise in a crowded space ("babble noise"), for example, these two types of noise will usually be perceived very differently. A blanking scheme that fails to distinguish between perceptually different types of noise may give rise to audible artifacts at the decoder. Because active frames also include the background noise, for example, an audible discontinuity may occur when the decoder switches from a decoded active frame to comfort noise that is generated from an inappropriate SID.

It is desirable for a blanking scheme to detect changes in the background noise which may be perceptually significant. For example, it may be desirable for a blanking scheme to detect a sudden change in one or more spectral characteristics of the background noise (e.g., spectral tilt). A method or apparatus as described herein may be used to implement such a blanking scheme. Alternatively, a method or apparatus as described herein may be used to supplement another blanking scheme. For example, a speech encoder or method of speech encoding may combine a method or apparatus as described herein with a blanking scheme as described in U.S. Pat. Appl. Publ. No. 2006/0171419 (Spindola et al., published Aug. 3, 2006) or with another blanking scheme that is configured to detect a change in frame energy and/or a change in a spectral characteristic of the speech signal, such as a difference between line spectral pair vectors.

FIG. 1A shows a flowchart of a method M100 according to a general configuration. Based on a plurality of inactive frames of a speech signal, task T200 generates a sequence of spectral tilt values. Task T400 calculates a change within the sequence of spectral tilt values (e.g., a change among at least two values of the sequence). For an inactive frame of the speech signal, task T500 decides whether to transmit a description for the frame, wherein the decision is based on the calculated change. For example, the decision whether to transmit a description may be based on a relation between (A) a magnitude of the calculated change and (B) a threshold value.

In a typical implementation of method M100, each among the sequence of spectral tilt values is based on a spectral tilt of a corresponding inactive frame. The spectral tilt of a frame of a speech signal is a value that describes a distribution of the energy within the frame over a frequency range. Typically the spectral tilt indicates a slope of the spectrum of the signal over the corresponding frame and may be positive or negative. The act of generating the next value of the sequence of spectral tilt values is also called "updating" the sequence.

The values of the sequence of spectral tilt values are usually arranged to be sequential in time, such that successive values of the sequence correspond to segments of the signal that are successive in time. A sequence of spectral tilt values arranged in this manner may be said to represent a contour that describes changes in the slope of the energy spectrum of the speech signal over time (i.e., a spectral tilt contour).

Task T200 may be implemented to generate the sequence of spectral tilt values in any of several different ways. For example, task T200 may be configured to receive such a sequence from a storage element or array (e.g., a semiconductor memory unit or array), from another task of a larger process such as a method of speech encoding, or from an element of an apparatus such as a speech encoder. Alternatively, task T200 may be configured to calculate such a sequence as described herein.

Task T200 may be configured to output the received or calculated sequence (also denoted herein as x) as the generated sequence of spectral tilt values. Alternatively, task T200 may be configured to generate a sequence of spectral tilt values y by performing one or more other operations on this sequence x. These other operations may include selecting another sequence from among the values of sequence x: for example, selecting every n-th value, where n is an integer greater than one, and/or selecting only those values that correspond to inactive frames. These other operations may also include smoothing the received, calculated, or selected sequence as described herein.

The duration of each segment in time (also called "segment" or "frame") of the speech signal is typically selected to be short enough that the spectral envelope of the signal may be expected to remain relatively stationary. For example, one typical frame length is twenty milliseconds, which corresponds to 160 samples at a sampling rate of eight kilohertz (kHz), although any frame length or sampling rate deemed suitable for the particular application may be used. In some applications, the frames are nonoverlapping, while in other applications, an overlapping frame scheme is used. For example, it is common for a speech coder to use an overlapping frame scheme at the encoder and a nonoverlapping frame scheme at the decoder.

In a typical application, an array of logic gates is configured to perform one, more than one, or even all of the various tasks of method M100. For example, such task or tasks may be implemented as machine-executable code to be executed by a programmable array such as a processor. The tasks of method M100 may also be performed by more than one such array. In these or other implementations, the tasks may be performed within a device for wireless communications such as a cellular telephone or other device having such communications capability. Such a device may be configured to communicate with circuit-switched and/or packet-switched networks (e.g., using one or more protocols such as VoIP). For example, such a device may include RF circuitry configured to transmit encoded active frames and SIDs. Method M100 may also be implemented as machine-readable code embodied in a computer program product (e.g., one or more data storage media such as disks, flash or other nonvolatile memory cards, semiconductor memory chips, etc.).

In a typical application of method M100, task T400 iterates over the sequence of spectral tilt values generated by task T200 to calculate a series of changes based on successive pairs of the spectral tilt values, and task T500 iterates over the series of changes to perform a series of transmit decisions. Generally task T200 executes as an ongoing process, and tasks T400 and T500 iterate serially or in parallel, such that a spectral tilt value and a corresponding calculated change and transmit indication are generated for each inactive frame of the speech signal (e.g., possibly after an initialization period of one or more inactive frames). It is also possible to implement method M100 such that task T200 generates a spectral tilt value less frequently than every inactive frame (e.g., for every second or third frame), such that task T400 is performed as frequently or less frequently than task T200 (e.g., for every second or third iteration of task T200), and/or such that task T500 is performed as frequently or less frequently than task T400 (e.g., for every second or third iteration of task T400).

Figure 1B:
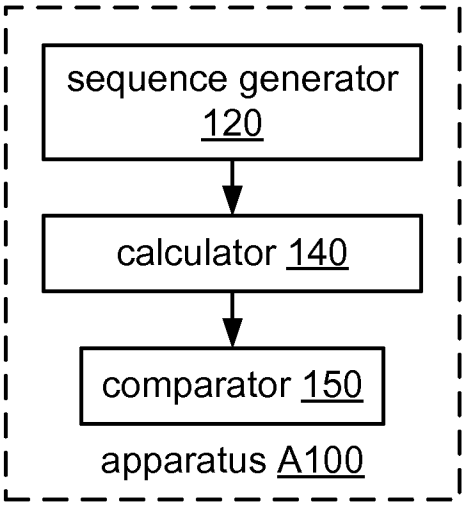
FIG. 1B shows a block diagram of an apparatus A100 according to a configuration.

FIG. 1B shows a block diagram of an apparatus A100 according to a general configuration. Sequence generator 120 is configured to generate a sequence of spectral tilt values that is based on a plurality of inactive frames of a speech signal. For example, sequence generator 120 may be configured to perform an implementation of task T200 as disclosed herein. Calculator 140 is configured to calculate a change among at least two values of the sequence of spectral tilt values. For example, calculator 140 may be configured to perform an implementation of task T400 as disclosed herein. Comparator 150 is configured to decide whether to transmit a description for an inactive segment of the speech signal, wherein the decision is based on the calculated change (e.g., on a relation between (A) a magnitude of the calculated change and (B) a threshold value). For example, comparator 150 may be configured to perform an implementation of task T500 as disclosed herein. In a typical application, an implementation of apparatus A100 is arranged to process a sequence of spectral tilt values and produce a series of transmit decisions based on the sequence.

The various elements of apparatus A100 may be implemented in any combination of hardware, software, and/or firmware that is deemed suitable for the intended application. For example, any of these elements may be implemented as one or more arrays of logic gates. Any two or more, or even all, of these elements may be implemented within the same array or arrays. Such an array or arrays may be implemented within one or more chips (for example, within a chipset including two or more chips). Any of the various elements of apparatus A100 may also be implemented as one or more computers (e.g., arrays programmed to execute one or more sets or sequences of instructions, also called "processors"), and any two or more, or even all, of these elements may be implemented within the same such computer or computers. The various elements of apparatus A100 may be included within a device for wireless communications such as a cellular telephone or other device having such communications capability. Such a device may be configured to communicate with circuit-switched and/or packet-switched networks (e.g., using one or more protocols such as VoIP). For example, such a device may include a speech encoder configured to transmit SIDs according to the outcomes of the corresponding transmit decisions and/or RF circuitry configured to transmit encoded active frames and SIDs.

One example of a parameter whose value may be used to indicate the spectral tilt of a frame is the first reflection coefficient $k_0$, and other such parameters are described below. Task T200 may be arranged to receive a sequence of spectral tilt values from another task of a larger procedure, such as a method of speech encoding. Alternatively, task T200 may be implemented to include a task T210 that is configured to calculate such values as described below. Likewise, sequence generator 120 may be arranged to receive a sequence of spectral tilt values from another element of a larger apparatus, such as a speech encoder or a communications device. Alternatively, sequence generator 120 may be implemented to include a calculator 128 that is configured to calculate such values as described below.

Figure 1C:
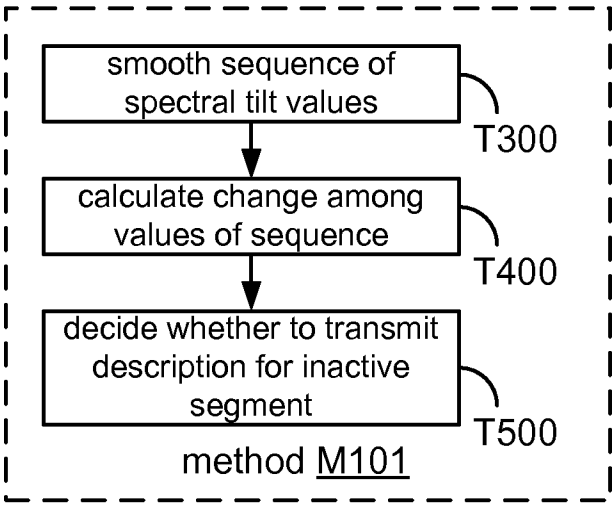
FIG. 1C shows a flowchart of an implementation M100 of method M100.
Figure 1D:
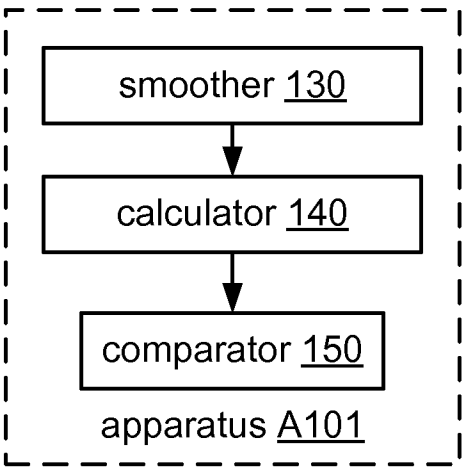
FIG. 1D shows a block diagram of an implementation A100 of apparatus A100.

Task T200 may be implemented to include a task T300 that smoothes a sequence of spectral tilt values. A typical implementation of task T300 is configured to filter a sequence of spectral tilt values according to an autoregressive model, such as an infinite impulse response (IIR) filter. A particular example of task T300 performs the following first-order IIR filtering operation to calculate each value of the smoothed sequence y as a weighted average of a current value of an input sequence of spectral tilt values x and a previous value of the smoothed sequence y:

$$y[n]=ax[n]+(1-a)y[n-1] \quad (1)$$

where n denotes a sequential index. Depending upon the desired degree of smoothing, gain factor a may have any value from 0 to 1. Generally, gain factor a has a value not greater than 0.6. For example, gain factor a may have a value in a range of from 0.1 (or from 0.15) to 0.4 (or to 0.5). In one particular example, the sequence x is a series of values of the first reflection coefficient $k_0$, and gain factor a has the value 0.2 (zero point two). FIG. 1C shows a flowchart of an implementation M101 of method M100 in which task T200 is implemented as task T300. FIG. 1D shows a block diagram of an implementation A101 of apparatus A100 in which sequence generator 120 is implemented as a smoother 130 which is configured to perform an implementation of task T300.

Figure 2:
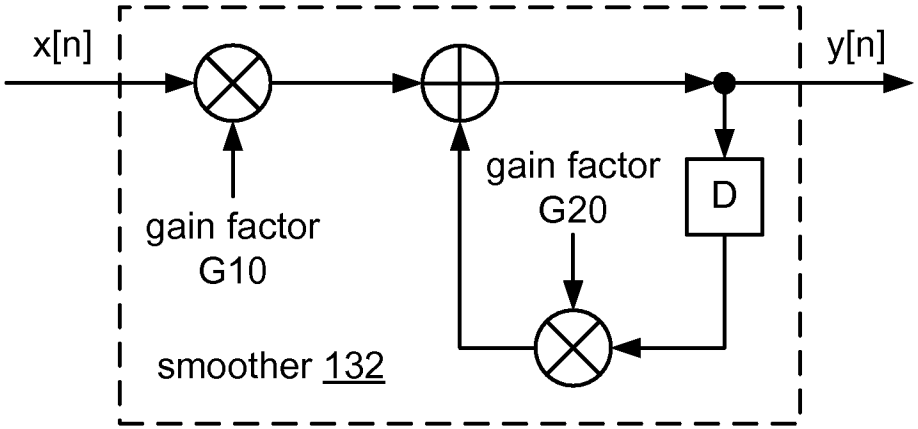
FIG. 2 shows a block diagram of an implementation 132 of smoother 130.

FIG. 2 shows a block diagram of one example of an implementation 132 of smoother 130. Smoother 132 includes a first multiplier arranged to apply a gain factor G10 to the current value x[n] of the input sequence of spectral tilt values; a second multiplier arranged to apply a gain factor G20 to the previous value y[n−1] of the smoothed sequence of spectral tilt values, as obtained from delay element D; and an adder arranged to output y[n] as the sum of the two products. It may be desirable (e.g., for stability) for gain factor G10 to have a value a as described above with reference to task T300 and for gain factor G20 to have the value (1−a). In one particular example, the sequence x is a series of values of the first reflection coefficient $k_1$, gain factor G10 has the value 0.2 (zero point two), and gain factor G20 has the value 0.8 (zero point eight). As noted above, smoother 132 may be implemented in any combination of hardware, software, and/or firmware that is deemed suitable for the intended application.

Alternatively or additionally, task T300 may be configured to calculate a value of the smoothed sequence of spectral tilt values y by performing one or more other averaging, integrating and/or lowpass filtering operations on the sequence of spectral tilt values x (or on the result of performing a smoothing operation on the sequence x). In an alternative implementation of method M100, for example, task T300 is configured to filter the sequence x according to a moving average model, such as a finite impulse response (FIR) filter. In a further alternative implementation of method M100, task T300 is configured to filter the sequence x according to an autoregressive moving average (ARMA) model. Similarly, smoother 130 may be implemented as an integrator or other lowpass filter (such as an FIR or ARMA filter) configured to produce a smoothed value based on two or more input values.

Method M100 is typically implemented such that each value of the sequence of spectral tilt values x that is smoothed in task T300 corresponds to one of a plurality of successive frames of the speech signal. Similarly, apparatus A100 is typically implemented such that each value of the sequence x that is smoothed by smoother 130 corresponds to one of a plurality of successive frames of the speech signal. It is noted that these successive frames need not be consecutive, as described in more detail below.

A speech signal will typically contain active frames as well as inactive frames. However, the distribution of energy during an active frame is likely to be due primarily to factors other than the background noise, such that energy distribution values from active frames are unlikely to provide reliable information about changes in the background noise. Therefore, it may be desirable for the sequence of spectral tilt values x to include only values that correspond to inactive frames. In such case, the values of the sequence x may correspond to successive (inactive) frames that are not consecutive in the speech signal.

Figure 3:
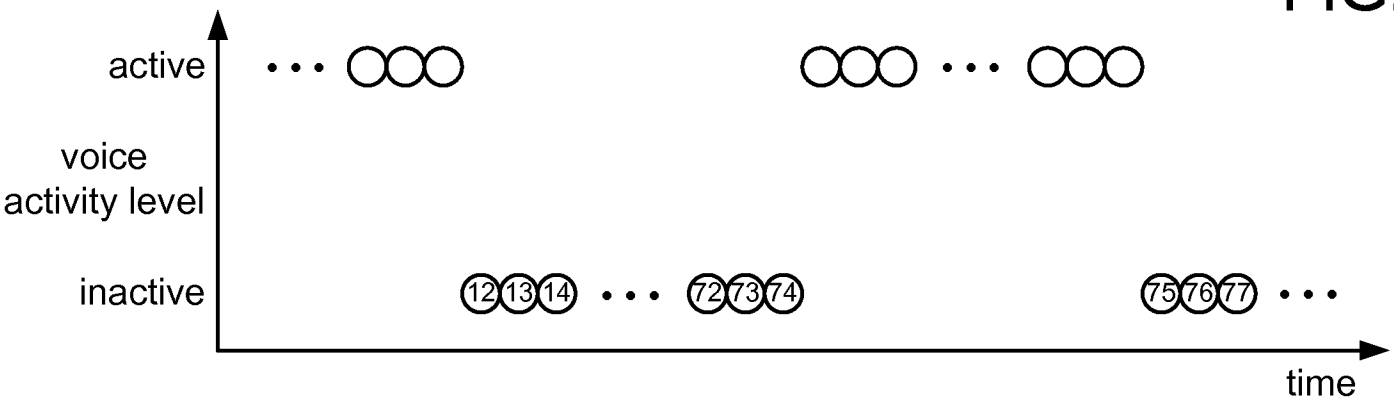
FIG. 3 shows an illustrative example in which each circle represents one of a series of consecutive frames of a speech signal over time.

To illustrate this principle, FIG. 3 shows an example in which each circle represents one of a series of consecutive frames of a speech signal over time. Circles which represent inactive frames are each marked with the index number of the corresponding value in the sequence of spectral tilt values x. In this example, values 74 and 75 are consecutive in the sequence. Although the inactive frames that correspond to the values 74 and 75 are successive in the speech signal, they are separated by a block of active frames and therefore are not consecutive to each other.

Method M100 may be arranged such that task T300 receives only spectral tilt values of sequence x that correspond to inactive frames. Alternatively, task T300 may be implemented to select, from among a sequence of spectral tilt values corresponding to consecutive frames, only those values that correspond to inactive frames. For example, such an implementation of task T300 may be configured to select spectral tilt values corresponding to inactive frames (and/or to reject values corresponding to active frames) based on a voice activity indication received from a speech encoder, a method of speech encoding, or a voice activity detection task T100 as described below.

Likewise, apparatus A100 may be arranged such that smoother 130 receives only spectral tilt values of sequence x that correspond to inactive frames. Alternatively, smoother 130 may be implemented to select, from among a sequence of spectral tilt values corresponding to consecutive frames, only those values that correspond to inactive frames. For example, such an implementation of smoother 130 may be configured to select spectral tilt values corresponding to inactive frames (and/or to reject values corresponding to active frames) based on a voice activity indication received from a speech encoder, a method of speech encoding, or a voice activity detector 110 as described below.

Figure 4:
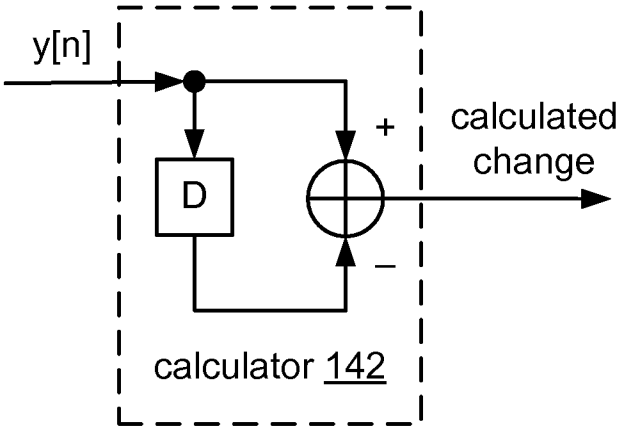
FIG. 4 shows a block diagram of an implementation 142 of calculator 140.

Task T400 calculates a change among at least two values of the sequence of spectral tilt values generated by task T200. For example, task T400 may be configured to calculate a difference (also called a "delta") between consecutive values of the smoothed sequence y according to an expression such as the following:

$$z[n]=y[n]-by[n-1], \quad (2)$$

where z denotes the output and b denotes a gain factor. FIG. 4 shows an implementation 142 of calculator 140 that may be used to perform a particular case of this example of task T400 in which b is equal to one (i.e., according to the first-order FIR high-pass filtering operation z[n]=y[n]−y[n−1]). Other implementations of calculator 140 and/or task T400 may be configured to apply such a filtering operation using a different value of b. For example, the value of b may be selected according to a desired frequency response. For a case in which task T200 is configured to generate a sequence x, such an implementation of task T400 or calculator 142 may be arranged to calculate a difference according to an expression such as z[n]=x[n]−x[n−1]. As noted above, calculator 142 may be implemented in any combination of hardware, software, and/or firmware that is deemed suitable for the intended application.

Alternatively or additionally, task T400 may be configured to perform one or more other differentiating operations on the generated sequence of spectral tilt values, such as a different high-pass filtering operation (e.g., applying a first-order IIR high-pass filter to the generated sequence), or otherwise calculating a distance or other change among values of the generated sequence. Similarly, calculator 140 may be implemented as a differentiator, difference calculator, or other highpass IIR or FIR filter configured to calculate a difference or other distance or change among two or more input values.

The change calculated by task T400 may be used to indicate a rate of change of the generated sequence of spectral tilt values. For example, the magnitude of z[n] as described above may be used to indicate how much the spectral tilt contour of the background noise has changed from one inactive frame to the next. Task T400 is typically arranged to iteratively calculate a series of distances whose magnitudes represent a rate of change of the smoothed contour at respective frame periods.

Task T500 decides whether to transmit a description for an inactive segment of the speech signal, wherein the decision is based on a corresponding change calculated by task T400. For example, task T500 may be configured to decide whether to transmit a description by comparing a magnitude of the calculated change with a threshold value T. Such an implementation of task T500 may be configured to set a binary flag according to the result of this comparison:

$$p[n] = \begin{cases} 1, & |z[n]| > T \\ 0, & \text{otherwise} \end{cases}, \tag{3}$$

where the value of the flag p[n] indicates the outcome of the transmit decision. In this case, a p[n] value of one or logical TRUE is a positive transmit indication (i.e., a transmit indication having a positive state, a transmit enable indication, an indication of a decision to transmit), indicating that an update to the silence description should be transmitted for the current frame; and a p[n] value of zero or logical FALSE is a negative transmit indication (i.e., a transmit indication having a negative state, a transmit disable indication, an indication of a decision not to transmit), indicating that no update to the silence description should be transmitted for the current frame. In one example, the threshold T has a value of 0.2. A lower threshold value may be used to provide greater sensitivity to variations in the generated sequence of spectral tilt values, while a higher threshold value may be used to provide greater rejection of transients in the generated sequence of spectral tilt values.

One of skill in the art will recognize that in an alternate implementation of method M100, task T400 may be configured to calculate the change as a magnitude according to an expression such as the following:

$$z[n]=|y[n]-by[n-1]|9,$$

and that task T500 may be configured to set a binary flag according to the result of a comparison such as the following:

$$p[n] = \begin{cases} 1, & z[n] > T \\ 0, & \text{otherwise} \end{cases}.$$

Method M100 may also be implemented to include a different variation of task T500, such as an implementation that compares a threshold value to an average magnitude of two or more of the calculated changes (e.g., an average magnitude of the calculated changes for the current and previous frames).

Figure 5:
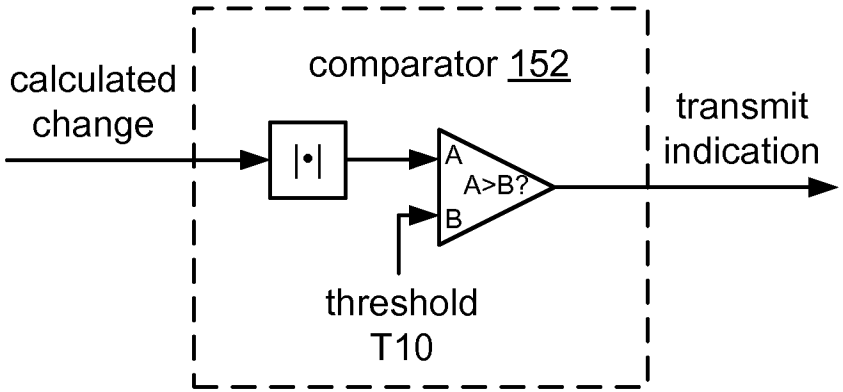
FIG. 5 shows a block diagram of an implementation 152 of comparator 150.
Figure 6:
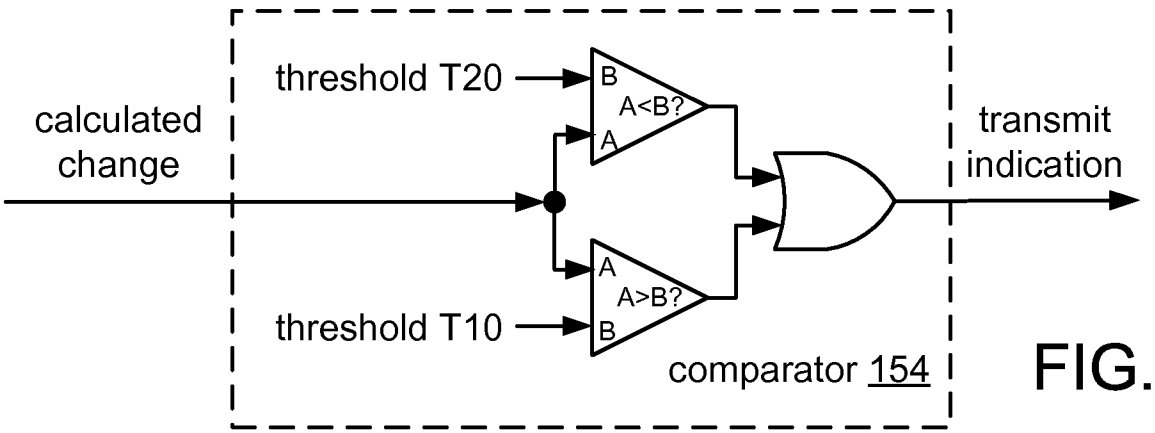
FIG. 6 shows a block diagram of an implementation 154 of comparator 150.

FIG. 5 shows a block diagram of an implementation 152 of comparator 150 that may be used to perform an implementation of task T500. In this example, comparator 152 is configured to perform the transmit decision by calculating the magnitude of the calculated change and comparing the magnitude to a threshold value T10. In one particular example, the threshold T10 has a value of 0.2 (zero point two). FIG. 6 shows a block diagram of another implementation 154 of comparator 150 that may be used to perform an implementation of task T500. In this example, comparator 154 is configured to compare a signed value of the calculated change with positive and negative threshold values T10 and T20, respectively, and to issue a positive transmit indication if the calculated change is greater than (alternatively, not less than) threshold value T10 or less than (alternatively, not greater than) threshold value T20. In one example, threshold value T20 has a value that is the negative of threshold value T10, such that comparators 152 and 154 are configured to produce the same result. However, comparator 154 may also be implemented such that threshold value T20 has a different magnitude than threshold value T10 if desired.

Figure 7A:
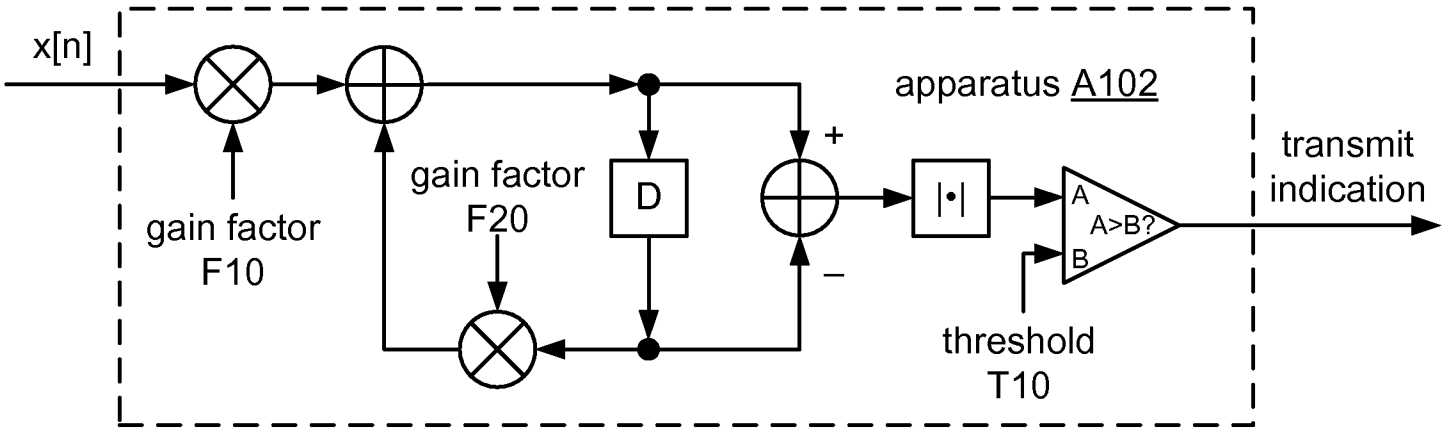
FIG. 7A shows a block diagram of an implementation A102 of apparatus A100.

A further implementation of comparator 150 is arranged to receive the calculated change from calculator 140 as a magnitude and to compare this magnitude with threshold T10. As noted above, such implementations of comparator 150 (i.e., including comparators 152 and 154) may be implemented in any combination of hardware, software, and/or firmware that is deemed suitable for the intended application. FIG. 7A shows a block diagram of one implementation A102 of apparatus A100 that is configured to perform various operations as described above on input signal x[n] to produce a corresponding transmit indication.

FIG. 8A shows one example of a source code listing for a set of instructions that may be executed by a programmable array of logic elements or other state machine (e.g., a computer or processor) to perform an implementation of method M101 that includes implementations of tasks T300, T400, and T500. In this example, the variable $k_0$ holds the spectral tilt value x[n] for the current frame, the variable y_current initially holds the most recent value of the smoothed sequence of spectral tilt values y, and flag p holds the state of the transmit indication. Part 1 performs task T300 by calculating a current value of the smoothed sequence y according to expression (1) above, using a value of 0.2 for gain factor a. Part 2 performs task T400 by calculating a change among the current and most recent values of the smoothed sequence y according to expression (2) above, using a value of one for gain factor b. Part 3 performs task T500 by setting the flag p according to the result of a comparison between the calculated change and a threshold value, using a threshold value of 0.2. In a typical application, the set of instructions is executed iteratively (e.g., for each inactive frame), such that the initial value of the variable y_current for each iteration is the final value of the variable y_current as calculated during the previous iteration.

As described above, task T300 may be configured to calculate a current value of the smoothed sequence of spectral tilt values y based on one or more past values of a sequence of spectral tilt values x and/or one or more past values of the smoothed sequence y. For an initial value of the smoothed sequence y, however, a past value of the sequence x and/or of the smoothed sequence y may not exist. If task T300 calculates a value of the smoothed sequence y using an arbitrary value or a zero value in place of a past value, the result may cause task T400 to output a calculated change that is inappropriately large, which may in turn lead task T500 to output a positive transmit indication even in a case where the spectral tilt contour is actually constant.

It may be desirable to initialize one or more variables (e.g., data storage locations) that are configured to hold past values of the sequence x and/or of the smoothed sequence y. Such initialization may be performed before task T300 is first executed and/or may be performed within task T300. For example, one or more such variables may be initialized to the current value of the sequence x. In a particular example, a variable configured to store the past value of the smoothed sequence ([n−1] in expression (1) above) is initialized to the current value of the input sequence (x[n] in expression (1) above). For a different example in which task T400 is arranged to calculate a change based on the values x[n] and x[n−1], a variable configured to store the past value of the input sequence x[n−1] is initialized to the current value of the input sequence x[n]. Alternatively or additionally, method M100 may be configured to avoid outputting positive transmit indications for the first few inactive frames (e.g., by forcing task T500 to output transmit indications having negative states for those frames). In such case, task T200 (possibly including task T300) may be configured to use an arbitrary or zero initial value for each of one or more past values instead of initializing those variables as described herein.

FIG. 8B shows another example of a source code listing for a set of instructions that may be executed by a programmable array of logic elements or other state machine (e.g., a processor) to perform an implementation of method M101 that includes an implementation T310 of task T300 as well as implementations of tasks T400 and T500. In this example, task T310 includes an initialization operation that uses a variable Y_VALID to indicate whether the set of instructions has been called before and thus whether the value stored in the variable y_current is valid. In this case, the calling routine (e.g., a larger procedure such as a method of speech encoding) would be configured to initialize the value of Y_VALID to FALSE before calling the set of instructions. If the set of instructions determines that the value of Y_VALID is FALSE (i.e., if the set of instructions is executing for the first time), then the variable y_current is initialized to the current value of the variable k0.

A silence description (SID) typically includes a description of a spectral envelope of a frame and/or a description of an energy envelope of a frame. These descriptions may be derived from the current inactive frame and/or from one or more previous inactive frames. An SID may also be called by other names such as "update to the silence description," "silence descriptor," "silence insertion descriptor," "comfort noise descriptor frame," and "comfort noise parameters." In the particular example of an Enhanced Variable Rate Codec (EVRC) as described in the document 3GPP2 C.S0014-C version 1.0, "Enhanced Variable Rate Codec, Speech Service Options 3, 68, and 70 for Wideband Spread Spectrum Digital Systems", SIDs are encoded at eighth-rate (sixteen bits per frame) using a noise-excited linear prediction (NELP) coding mode, while active frames are encoded at full rate (171 bits per frame), half rate (80 bits per frame), or quarter rate (40 bits per frame) using code-excited linear prediction (CELP), prototype pitch period (PPP), or NELP coding modes.

A spectral envelope description generally includes a set of coding parameters such as filter coefficients, reflection coefficients, line spectral frequencies (LSFs), line spectral pairs (LSPs), immittance spectral frequencies (ISFs), immittance spectral pairs (ISPs), cepstral coefficients, or log area ratios. The set of coding parameters, which may be arranged as one or more vectors, is typically quantized as one or more indices into corresponding lookup tables or "codebooks."

Typical lengths of a spectral envelope description within an SID currently range from eight to 28 bits. In the particular example of an EVRC as described in 3GPP2 C.S0014-C version 1.0 referenced above, each sixteen-bit SID includes a four-bit index LSPIDX1 into a codebook for low-frequency information of the spectral envelope and a four-bit index LSPIDX2 into a codebook for high-frequency information of the spectral envelope. In the particular example of the Adaptive Multi Rate (AMR) speech codec, as described in the document ETSI TS 126 092 V6.0.0 (European Telecommunications Standards Institute (ETSI), Sophia Antipolis Cedex, FR, December 2004), each 35-bit SID includes an eight- or nine-bit-long index for each of three LSF subvectors. In the particular example of the AMR Wideband speech codec, as described in the document ETSI TS 126 192 V6.0.0 (ETSI, December 2004), each 35-bit SID includes a five- or six-bit-long index for each of five ISF subvectors.

An energy envelope description may include a gain value to be applied to the frame (also called a "gain frame"). Alternatively or additionally, an energy envelope description may include gain values to be applied to each of a number of subframes of the frame (collectively called a "gain profile"). Typically the gain frame and/or the gain profile are quantized as one or more indices into corresponding codebooks, although in some cases an algorithm may be used to quantize and/or dequantize the gain frame and/or gain profile without using a codebook. Typical lengths of an energy envelope description within an SID currently range from five to eight bits. In the particular example of an EVRC as described in 3GPP2 C.S0014-C v.1.0 referenced above, each sixteen-bit SID includes an eight-bit energy index FGIDX. In the particular examples of the AMR speech codec as described in ETSI TS 126 092 V6.0.0 referenced above and the AMR Wideband speech codec as described in ETSI TS 126 192 V6.0.0 referenced above, each 35-bit SID includes a six-bit energy index.

Method M100 or apparatus A100 may be used as a blanking scheme to support DTX. For example, a procedure including method M100 or a device including apparatus A100 may be configured to perform transmission of an SID only when the state of the transmit indication produced by task T500 is positive. Other blanking schemes may also be used to support DTX. One such example is a method or apparatus that issues a positive SID transmit indication whenever the number of consecutive inactive frames that have occurred since the most recent SID transmission reaches (alternatively, exceeds) a threshold DTX_MAX. Typical values for DTX_MAX include 16 and 32. A further example of a blanking scheme issues a positive SID transmit indication whenever the number of consecutive inactive frames that have occurred since the most recent active frame reaches (alternatively, exceeds) a threshold.

Other blanking schemes that may be used to support DTX include schemes that are configured to issue a positive SID transmit indication upon detecting a change in the energy and/or spectral envelope descriptions of the speech signal. For example, such a scheme may be configured to issue a positive SID transmit indication, indicating a decision to transmit a description for the current inactive frame, upon detecting that a distance between the spectral envelope descriptions (e.g., the LSF, LSP, ISF, or ISP vectors) of the frame and of the last transmitted SID exceeds a threshold value (alternatively, is not less than a threshold value). It may be desirable to filter (e.g., smooth) the spectral envelope descriptions before calculating the distances. A variation of such a scheme is configured to issue a positive SID transmit indication if it also detects that a distance between the energy envelope descriptions of the current inactive frame and the last transmitted SID exceeds a threshold value (alternatively, is not less than a threshold value). A further variation is configured to issue a positive SID transmit indication if it detects that either of these conditions is satisfied. Other blanking schemes that may be used include schemes configured to issue a positive SID transmit indication according to a comparison between a threshold value and a value such as a mean absolute value of the frame or an energy value of the frame (e.g., a sum of squares of the samples), which value may be filtered and/or weighted.

Another example of a blanking scheme that may be used to support DTX is configured to issue a positive SID transmit indication upon detecting that the Itakura distance between the last transmitted SID and the current inactive frame exceeds a threshold value (alternatively, is not less than a threshold value). A variation of such a scheme is configured to issue a positive SID transmit indication upon detecting that the Itakura distance between (A) the last transmitted SID and (B) an average of the current inactive frame and the previous inactive frame exceeds a threshold value (alternatively, is not less than a threshold value). The Itakura distance is a measure of spectral change based on autocorrelation and residual energy values, and a description of such a scheme may be found in ITU-T Recommendation G.729 Annex B (International Telecommunication Union, Geneva, CH, October 1996).

Figure 7B:
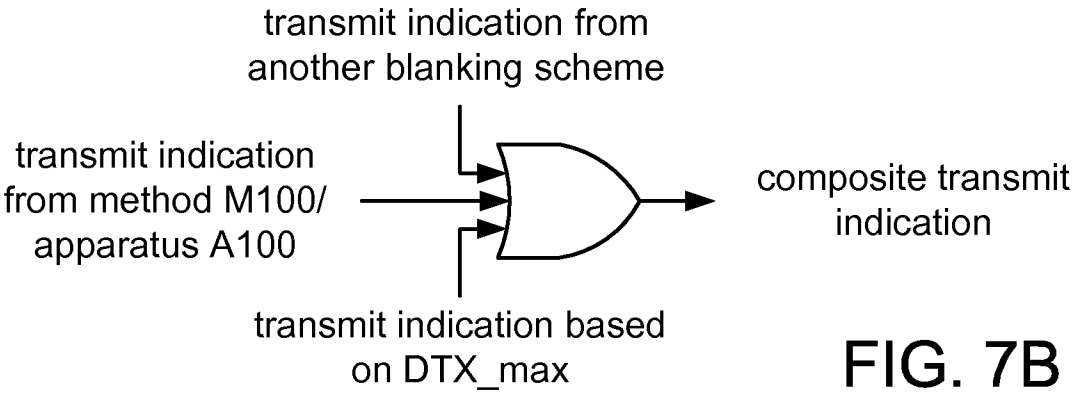
FIG. 7B shows an example in which several different transmit indications are combined into a composite transmit indication.

An implementation of method M100 or apparatus A100 may be combined with one or more other blanking schemes, such as one or more of those described above. For example, an apparatus including or performing such an implementation may be configured to transmit an SID if any of its blanking schemes issues a positive SID transmit indication for that frame. FIG. 7B shows one implementation of such an example in which several different transmit indications are combined into a composite transmit indication using a logical OR operation.

As noted above, an SID may be derived from one or more inactive frames. For example, it may be desirable for a device including apparatus A100 or a procedure including method M100 to calculate and transmit an SID that represents an average of several encoded inactive frames rather than to transmit the SID as a single encoded inactive frame. Such an average may be calculated using an FIR or IIR filtering operation and/or by using a statistical method such as median filtering, which may include discarding outliers or replacing outliers with a median value. For example, the device or procedure may be configured to calculate the SID by statistically smoothing the energy and spectral envelope descriptions of the current frame with those of one or more previous inactive frames so that the resulting SID contains gain and frequency values that have occurred most often in the recent past.

The number of frames over which the average is calculated may be fixed or may vary according to, for example, a measure of stationarity. One example of such a measure is a distance (e.g., the Itakura distance) between spectral averages taken over two different sets of frames. In one such example as described in G.729 Annex B referenced above, the average is calculated over the six past frames (including the current frame) and over the two past frames. If the distance between these two averages exceeds a threshold value (alternatively, is not less than a threshold value), then the SID includes a spectral description averaged over two frames (e.g., the signal is assumed to be locally nonstationary). Otherwise, the SID includes a spectral description averaged over six frames (e.g., the signal is assumed to be locally stationary). In the particular example of the AMR Wideband codec as described in ETSI TS 126 192 V6.0.0 referenced above, the SID includes a dithering indication whose state is set according to the sum of spectral distances between the current frame and the seven previous frames or according to a distance between the energy of the current frame and an average energy value over past frames.

Method M100 may be implemented such that task T200 receives the sequence of spectral tilt values from another process, such as a speech encoding process. For example, a device or system configured to execute an implementation of method M100 will typically also be configured to perform a method of speech encoding on the speech signal. A method of speech encoding may include a linear prediction coding (LPC) analysis, which calculates a set of coefficients that model a sample of a speech signal at time t as a linear combination of samples of the speech signal at times prior to t. An LPC analysis performed by a speech encoder of a communications device (e.g., a cellular telephone) typically has an order of four, six, eight, ten, 12, 16, 20, 24, 28, or 32. For a case in which separate LPC analyses are performed on different frequency bands of the speech signal, task T200 may be arranged to receive the sequence of spectral tilt values based on the analysis of a low frequency band (e.g., including frequencies below 1 kHz) or a midrange frequency band (e.g., including at least frequencies between 1 and 2 kHz).

Figure 9:
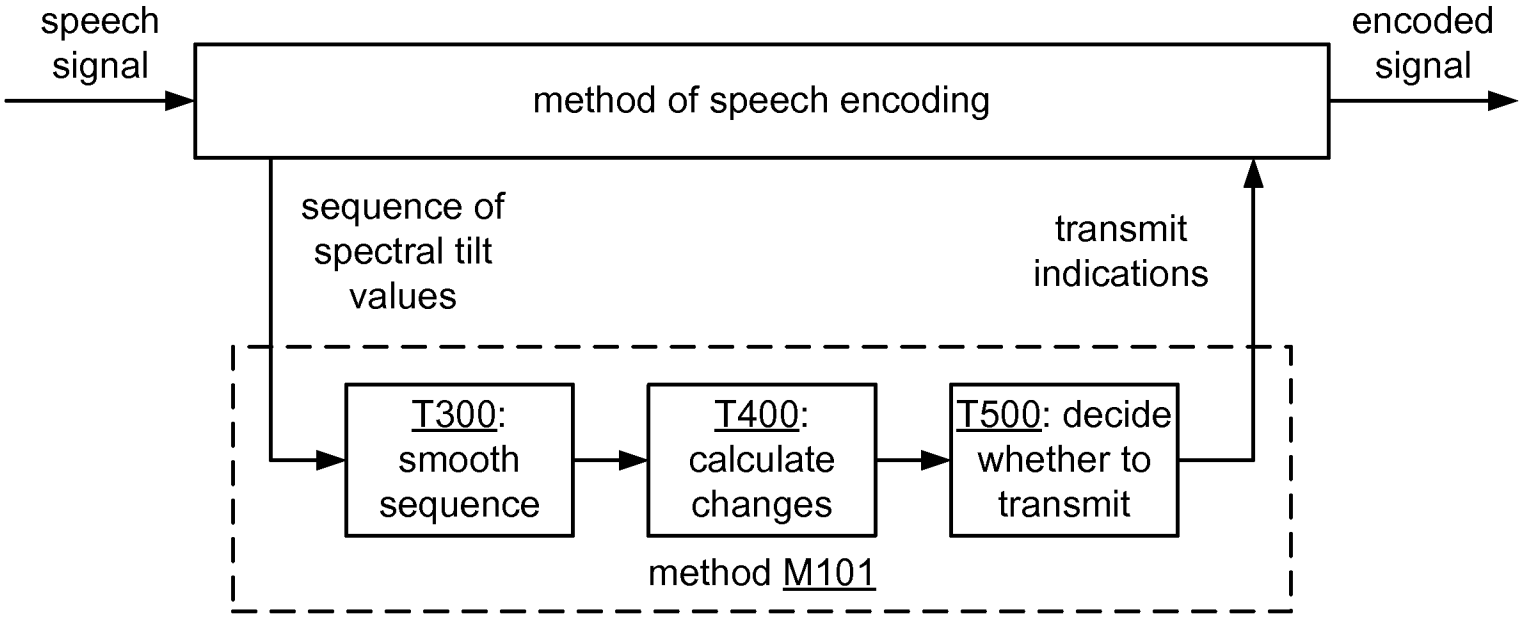
FIG. 9 shows a flowchart of a method that comprises a combination of method M101 and a method of speech encoding.

Task T200 may be arranged to receive the sequence of spectral tilt values as a sequence of reflection coefficients, such as a sequence of first or second reflection coefficients. The range of configurations disclosed herein includes methods that comprise a combination of method M100 and a method of speech encoding (e.g., as depicted in FIG. 9) as well as speech encoding methods that include method M100.

Figure 10:
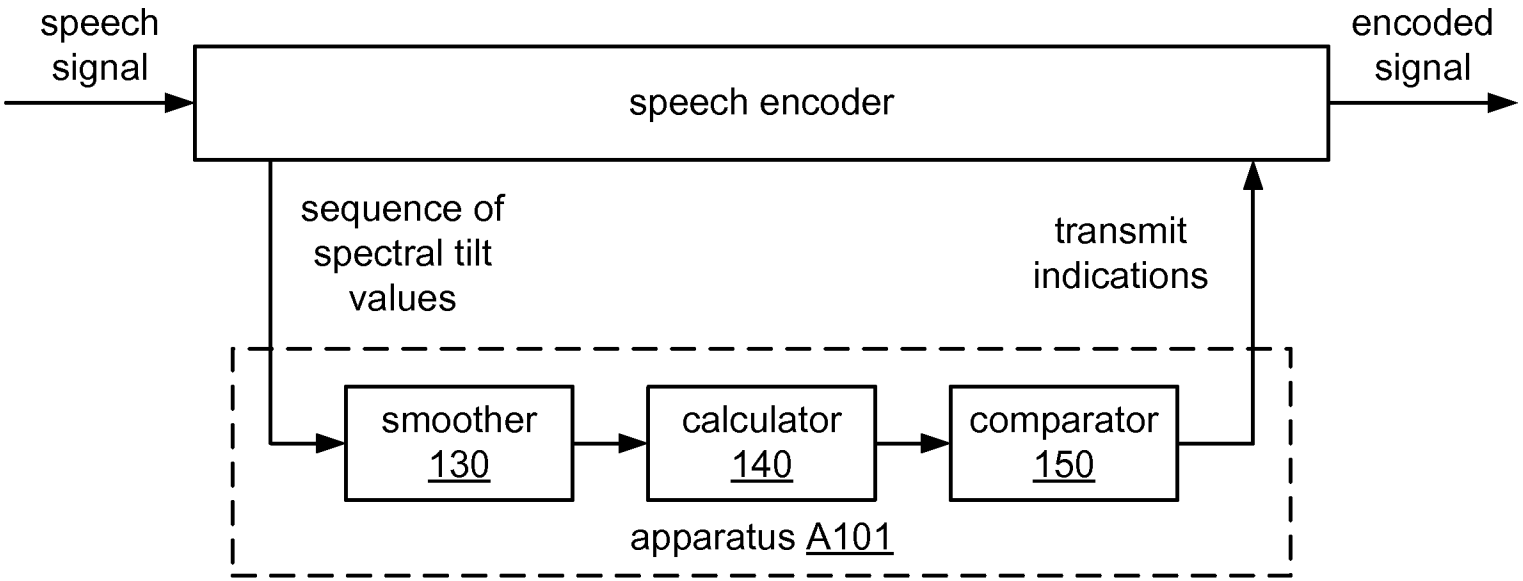
FIG. 10 shows a block diagram of an apparatus that comprises a combination of apparatus A101 and a speech encoder.

Apparatus A100 may be implemented such that sequence generator 120 receives the sequence of spectral tilt values from another apparatus, such as a speech encoder. For example, a device or system that includes an implementation of apparatus A100 will typically also include a speech encoder, which may be configured to perform an LPC analysis on the speech signal. In such case, sequence generator 120 may be arranged to receive the sequence of spectral tilt values as a sequence of reflection coefficients. The range of configurations disclosed herein includes apparatus that comprise a combination of apparatus A100 and a speech encoder (e.g., as depicted in FIG. 10) as well as speech encoders that include apparatus A100.

Alternatively, task T200 may be implemented to include a task T210 that calculates the sequence of spectral tilt values based on a plurality of inactive frames of the speech signal. Task T210 may be configured, for example, to evaluate the spectral tilt of the signal over each of a series of frames according to one or more of several different techniques as described below. FIG. 1A shows a flowchart of an implementation M200 of method M100 that includes such an implementation T202 of task T200. Task T210 may also be arranged to provide the calculated sequence of spectral tilt values to other tasks of a larger process, such as a method of speech encoding. Method M100 may also be implemented such that task T200 is implemented as task T210.

Figure 11B:
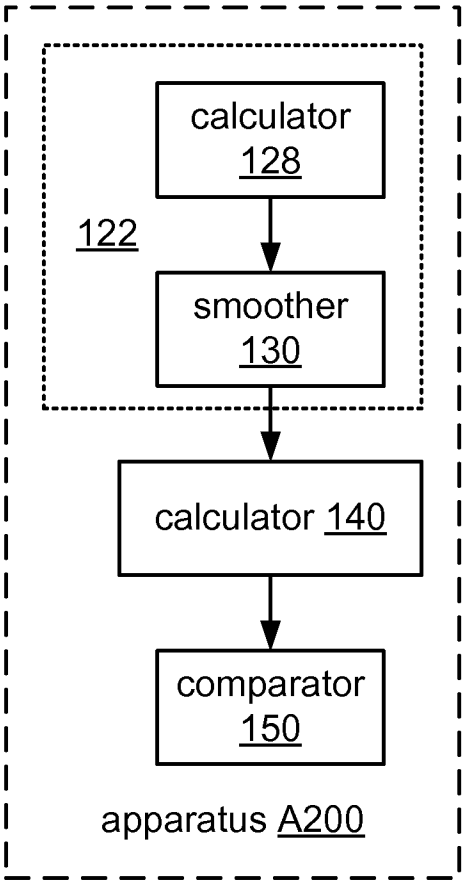
Figure 11A:
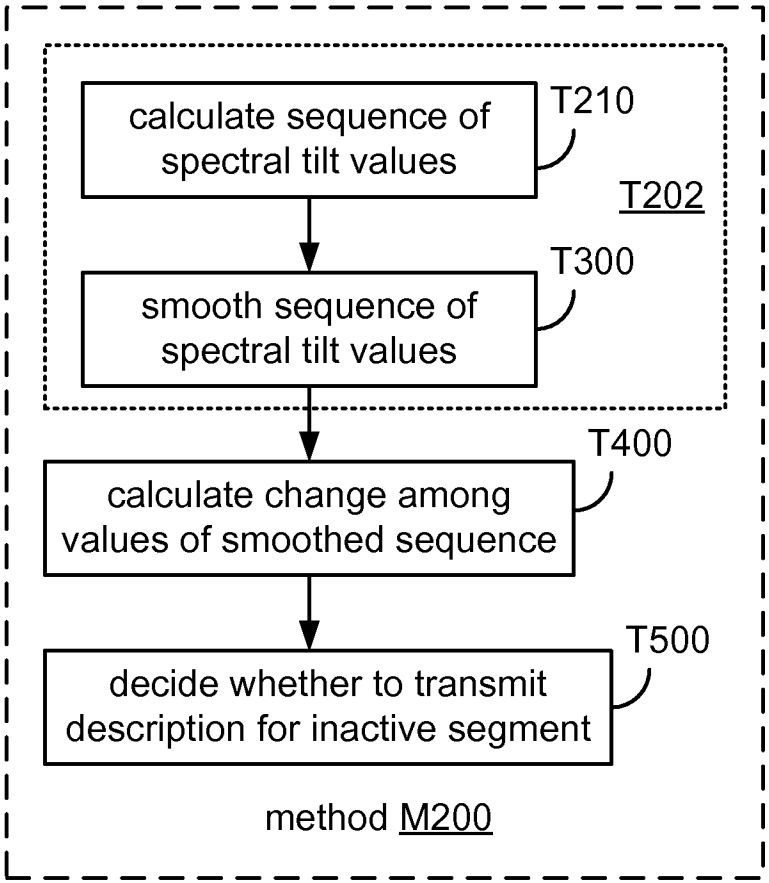

FIG. 11B shows a block diagram of an implementation A200 of apparatus A100 that includes an implementation 122 of sequence generator 120. Sequence generator 122 includes a calculator 128 which is configured to calculate the sequence of spectral tilt values based on a plurality of inactive frames of the speech signal. For example, calculator 128 may be configured to perform an implementation of task T210 as disclosed herein. Like the other elements of apparatus A200, calculator 128 may be implemented in any combination of hardware, software, and/or firmware that is deemed suitable for the intended application. Calculator 128 may also be arranged to provide the calculated sequence of spectral tilt values to other tasks of a larger apparatus, such as a speech encoder. Apparatus A100 may also be implemented such that sequence generator 120 is implemented as calculator 128.

A typical implementation of task T210 is configured to calculate a spectral tilt as the first reflection coefficient of a corresponding frame of the speech signal. The first reflection coefficient of a frame (typically denoted as $k_0$) may be calculated as the ratio R(1)/R(0) (i.e., the normalized first autocorrelation value of the frame), which has a scalar value between −1 and +1 for sample values in the range of from −1 to +1. In this expression, R(1) denotes the first autocorrelation coefficient of the frame (i.e., the value of the autocorrelation function for the frame at a lag of one sample) and R(0) denotes the zeroth autocorrelation coefficient of the frame (i.e., the value of the autocorrelation function for the frame at a lag of zero).

In other implementations, task T210 is configured to calculate a spectral tilt as the second reflection coefficient of a corresponding frame of the speech signal. The second reflection coefficient of a frame (typically denoted as $k_1$) may be calculated as:

$$k_1 = \frac{R(2) - k_1 R(1)}{(1 - k_1^2)R(0)} = \frac{R(0)R(2) - R(1)^2}{R(0)^2 - R(1)^2}$$

where R(2) denotes the second autocorrelation coefficient of the frame (i.e., the value of the autocorrelation function for the frame at a lag of two samples). Task T210 may also be implemented to calculate one or more reflection coefficients of a corresponding frame (e.g., the first and/or second reflection coefficient) based on one or more other parameters, such as one or more LPC filter coefficients.

The range of implementations of task T210 is not limited to those which calculate the spectral tilt as a reflection coefficient. Alternatively or additionally, task T210 may be configured to perform one or more other spectral evaluation techniques to calculate a spectral tilt of a frame or frames. Such spectral evaluation techniques may include calculating a spectral tilt for each frame as a ratio between energy of a high-frequency band and energy of a low-frequency band. Such calculation may include performing a frequency transform on the segment, such as a discrete Fourier transform (DFT). Such spectral evaluation techniques may include calculating the spectral tilt as the number of zero crossings within each segment. In such case, a higher number of zero crossings may be taken to indicate a greater amount of high-frequency energy.

In calculating the sequence of spectral tilt values, task T210 may be configured to perform a calculation based on values of the autocorrelation function, such as calculating one or more reflection coefficients as described above. An autocorrelation method of calculating LPC model parameters, such as filter or reflection coefficients, involves performing a series of iterations to solve an equation that includes a Toeplitz matrix. In some implementations, task T210 is configured to perform an autocorrelation method according to any of the well-known recursive algorithms of Levinson and/or Durbin for solving such an equation. Such an algorithm typically calculates reflection coefficients (also called partial correlation (PARCOR) coefficients, negative PARCOR coefficients, or Schur-Szego parameters) as intermediates in the process of producing a set of LPC filter coefficients.

In other implementations, task T210 is configured to perform a series of iterations to calculate one or more reflection coefficients rather than a set of filter coefficients. For example, task T210 may be configured to use an implementation of the Leroux-Gueguen algorithm to obtain one or more reflection coefficients. Alternatively, task T210 may be configured to use an implementation of another well-known iterative method to obtain one or more reflection coefficients from the autocorrelation values, such as the Schur recursive algorithm (which may be configured for efficient parallel computation) or the Burg recursive algorithm.

Task T210 may be configured to calculate one or more values of the autocorrelation function for a corresponding frame of the speech signal. For example, task T210 may be configured to evaluate the autocorrelation function of a frame for a particular lag value m (where m is an integer not less than zero) according to an expression such as the following:

$$R(m) = \sum_{i=0}^{N-1-m} s[i]s[i+m],$$

where N denotes the number of samples in the frame. Alternatively, task T210 may be configured to receive values of the autocorrelation function (e.g., from a speech encoder or a method of speech encoding or other process).

A speech encoder or method of speech encoding may be configured to use values of the autocorrelation function in a coding operation such as calculating parameters of an LPC model (e.g., filter and/or reflection coefficients). It may be desirable for such a speech encoder or speech encoding method to perform one or more preprocessing operations on the autocorrelation values. For example, the autocorrelation values R(m) may be spectrally smoothed by performing an operation such as the following:

$$R_w(m) = \begin{cases} 1.00003R(m), & m = 0; \\ e^{\left[-\frac{1}{2}\left(\frac{40\pi m}{8000}\right)^2\right]}R(m), & m > 0. \end{cases}$$

In such a context, task T210 may be configured to perform spectral smoothing or another preprocessing operation on the autocorrelation values and/or to calculate values of the spectral tilt parameter using autocorrelation values that have been spectrally smoothed or otherwise preprocessed.

Before the autocorrelation function is applied to the speech signal (e.g., by task T210 or a speech encoder or method of speech encoding), it may be desirable to apply a windowing function w[n] to the signal. For example, it may be desirable to zero the speech signal outside the frame to which the autocorrelation function is currently being applied. In some cases, the windowing function w[n] is rectangular or triangular. It may be desirable to use a tapered windowing function having low sample weights at each end of the window, which may help to reduce the effect of components outside the window. For example, it may be desirable to use a raised cosine window, such as the following Hamming window function:

$$w[n] = \begin{cases} 0.54 - 0.46\cos\frac{2\pi n}{N-1}, & 0 \le n \le N-1 \\ 0, & \text{elsewhere} \end{cases}$$

where N is the number of samples in the frame.

Other tapered windows that may be used include the Hanning, Blackman, Kaiser, and Bartlett windows. The windowed frame $s_w[n]$ may be calculated according to an expression such as the following:

$$s_w[n]=s[n]w[n];\ 0 \le n \le N-1.$$

The windowing function need not be symmetric, such that one half of the window may be weighted differently than the other half. A hybrid window may also be used, such as a Hamming-cosine window or a window having two halves of different windows (for example, two Hamming windows of different sizes). One or more other preprocessing operations, such as perceptual weighting, may be performed on the sample values and/or on the windowed values (e.g., by task T210 or a speech encoder or method of speech encoding) before they are used to evaluate the autocorrelation function.

The windowing function w[n] may be configured to include the samples of the current frame as well as samples from one or more adjacent frames. In some cases, the window includes samples from the current frame and the adjacent previous and future frames (e.g., a 5-20-5 window that includes the 5 milliseconds immediately before and after a 20-millisecond frame). In other cases, the window includes samples from only the current frame and the adjacent previous frame (e.g., a 10-20 window that includes the current 20-millisecond frame and the last 10 milliseconds of the preceding frame).

For a case in which a windowing function is applied to the speech signal (e.g., by task T210 or a speech encoder or method of speech encoding), the autocorrelation function of a frame may be calculated according to an expression such as the following:

$$R(m) = \sum_{i=0}^{N-1-m} s_w[i]s_w[i+m].$$

As noted above, it may be desirable for task T300 or smoother 130 to smooth a sequence that includes only values that correspond to inactive frames. In such case, method M100 or apparatus A100 may be arranged to receive an indication of the level of voice activity in a frame (e.g., from a speech encoder or method of speech encoding). For example, such an indication (also called a "voice activity indication") may have the form of a binary variable or flag whose state indicates whether a corresponding frame is active or inactive.

A voice activity indication may be used to control an operation of smoothing task T300. For example, the voice activity indication may be used to allow generation of a smoothed spectral tilt value from a corresponding inactive frame and/or to prevent generation of a smoothed spectral tilt value from a corresponding active frame. In one such example, a computer or processor is configured to control task T300 to smooth a spectral tilt value only if the voice activity indication indicates that the corresponding frame is an inactive frame. Alternatively, task T300 may include a decision of whether to generate a smoothed spectral tilt value or not, or of whether to accept or reject a spectral tilt value, according to the value of a corresponding voice activity detection.

Figure 12A:
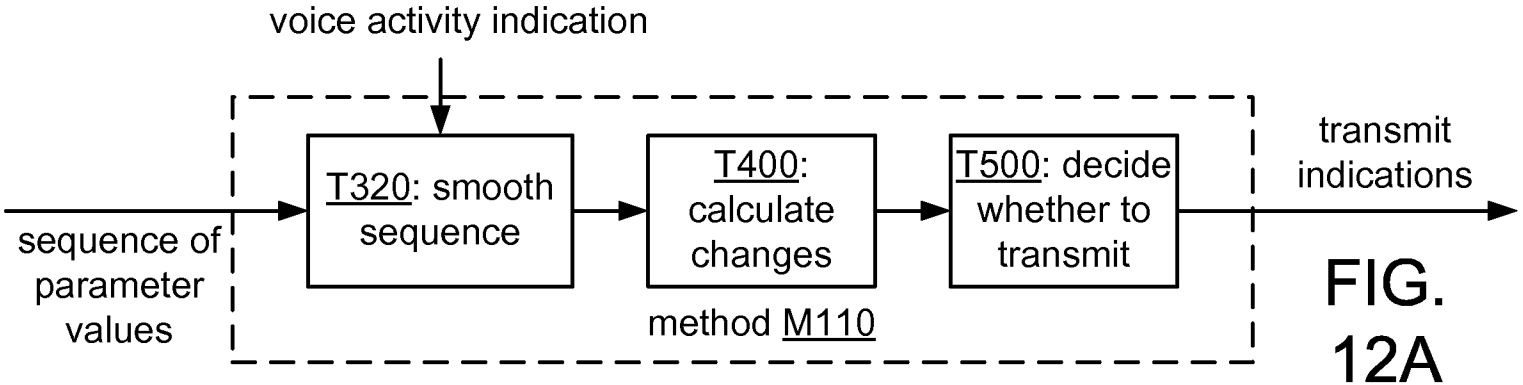
FIG. 12A shows a flowchart of an implementation M10 of method

FIG. 12A shows a flowchart of an implementation M110 of method M101 that includes such an implementation T320 of task T300.

Figure 12B:
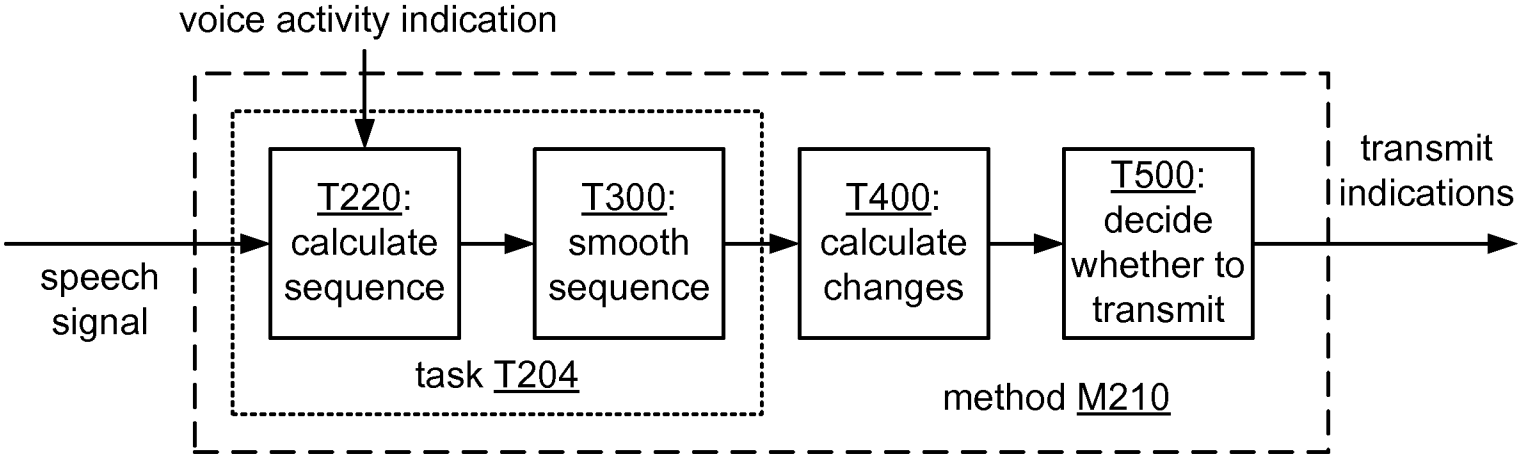
FIG. 12B shows a flowchart of an implementation M210 of method M200.

A voice activity indication may be used to control an operation of calculation task T210. For example, the voice activity indication may be used to allow generation of a spectral tilt for a corresponding inactive frame and/or to prevent generation of a spectral tilt for a corresponding active frame. In one such example, a processor is configured to control task T210 to calculate a spectral tilt only if the voice activity indication indicates that the current frame is an inactive frame. Alternatively, task T210 may be configured to include a decision of whether to generate a spectral tilt for a given frame, or may be configured to control its input (e.g., to accept or reject a frame) and/or its output (e.g., whether to issue a spectral tilt value), according to the value of a corresponding voice activity indication. FIG. 12B shows a flowchart of an implementation M210 of method M200 that includes an implementation T204 of task T202, where task T204 includes such an implementation T220 of task T210.

Figure 12C:
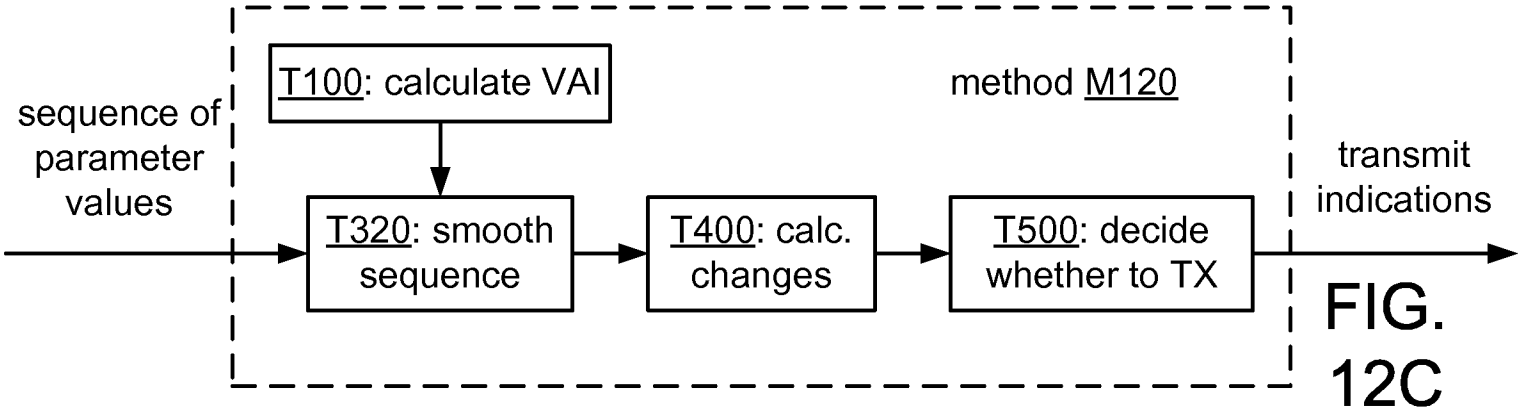
FIG. 12C shows a flowchart of an implementation M120 of method
Figure 12D:
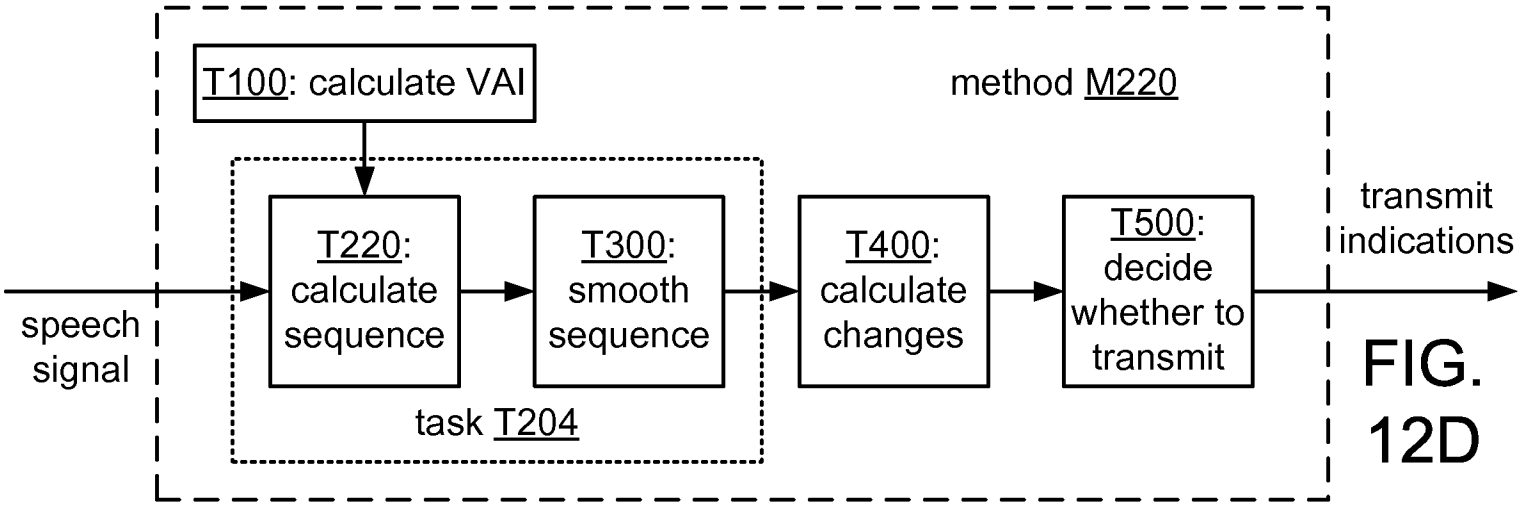
FIG. 12D shows a flowchart of an implementation M220 of method M200.

As an alternative to receiving a voice activity indication, method M100 may be implemented to include a task T100 that is configured to indicate whether a frame is active or inactive. For example, task T100 may be configured to calculate a voice activity indication (VAI) as described above. FIG. 12C shows a flowchart of an implementation M120 of method M101 that includes task T100, and FIG. 12D shows a flowchart of an implementation M220 of method M200 that includes task T100. Task T100 may be configured to classify a frame as active or inactive based on one or more factors such as full-band energy, low-band energy, high-band energy, spectral parameters (e.g., one or more LSFs and/or reflection coefficients), periodicity, and zero-crossing rate. For example, such classification may include comparing a value of such a characteristic to a fixed or adaptive threshold value, and/or calculating the magnitude of a change in the value of such a characteristic (e.g., the magnitude of a difference between two values, or the magnitude of a difference between a value and a running average) and comparing the magnitude to a fixed or adaptive threshold value.

Task T100 may be configured to evaluate the energy of the current frame in each of a low-frequency band and a high-frequency band, and to indicate that the frame is inactive if the energy in each band is less than (alternatively, not greater than) a respective threshold. Such thresholds may be fixed or adaptive. For example, each threshold may be based on a desired encoding rate. One example of a pair of adaptive thresholds is described in Section 4.7 of C.S0014-C v.1.0 referenced above. In this example, the threshold for each band is based on an anchor operating point (as derived from a desired average data rate), an estimate of the background noise level in that band for the previous frame, and a signal-to-noise ratio in that band for the previous frame.

A transition from active speech to inactive speech typically occurs over a period of several frames, and the first several inactive frames after a transition from active speech may include remnants of voicing in addition to the background noise. The voicing remnants may cause these post-transition inactive frames to have spectral tilts that differ from those of the background noise, and these differences may corrupt the sequence of spectral tilt values generated by task T200 and lead to unnecessary SID transmission.

As noted above, it may be desirable for task T200 to produce a value of the sequence x that is based on inactive frames only. Likewise, it may be desirable for task T300 to produce a value of the smoothed sequence y that is based on one or more spectral tilt values from inactive frames only. It may also be desirable for an implementation of method M100 to avoid using spectral tilt values from one or more post-transition frames to update the spectral tilt contour. Such a limitation may help to reduce a probability of false positives by decision task T500.

Figure 13A:
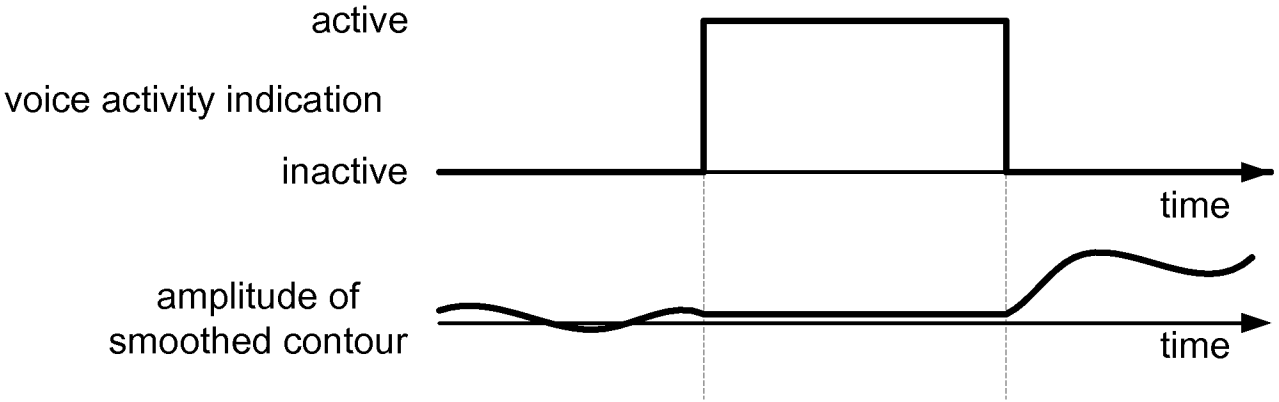
FIGS. 13A and 13B show examples of a smoothed spectral tilt contour without and with application of a hangover, respectively.
Figure 13B:
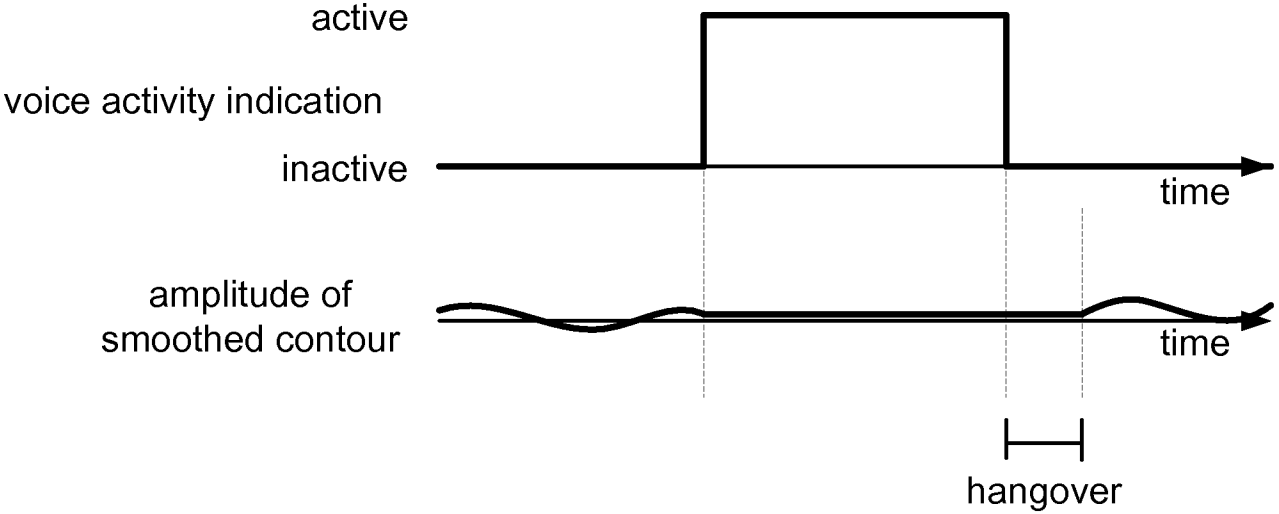

Task T200 may be configured to generate one or more values of the generated sequence of spectral tilt values according to a distance in time between the corresponding inactive frame and the preceding active frame. For example, such an implementation of task T200 or task T300 may be configured to delay or suspend, for one or more inactive frames, the start of updating of the spectral tilt contour following a transition from active speech. FIGS. 13A and 13B illustrate examples of the effects of such a transition and of such a delay or suspension, respectively. FIG. 13A shows a sharp change in the amplitude of a smoothed spectral tilt contour caused by voicing remnants in the post-transition frames. Such a change may lead to an undesirable positive SID transmit decision. In this particular example, the spectral tilt parameter is the first reflection coefficient $k_0$, such that the voicing remnants cause a sharp rise in the amplitude of the smoothed spectral tilt contour, although voicing remnants may cause a sharp decrease in amplitude instead for a case in which another spectral tilt parameter is used. By way of comparison, FIG. 13B shows an example in which a delay (also called a "hangover") is applied to disable updating of the smoothed contour during the post-transition frames. In this case, the sharp rise seen in FIG. 13A does not occur. In one particular example, a hangover of five frames is used following a transition from active to inactive speech.

Figures 14, 15:
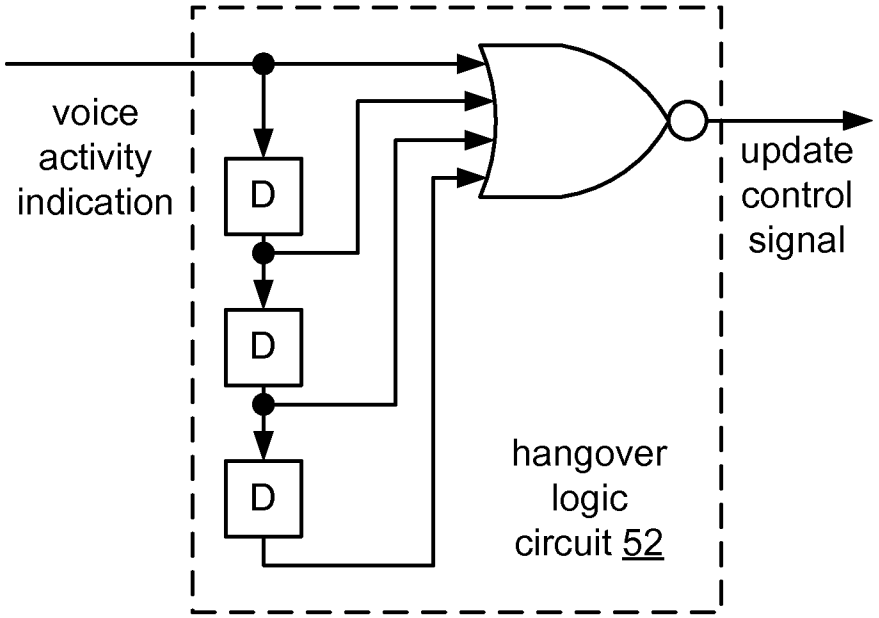
FIG. 14 shows a source code listing for a set of instructions that may be executed to perform a further implementation of method M100.
FIG. 15 shows a block diagram of an example of a hangover logic circuit.

FIG. 14 shows an example of a source code listing for a set of instructions that may be executed by a programmable array of logic elements or other state machine (e.g., a processor) to perform an implementation of method M100 that includes an implementation T312 of task T310 as well as implementations of tasks T400 and T500. In this example, task T312 reads a variable FRAME_ACTIVE which stores the current state of the voice activity indication. If the value of FRAME_ACTIVE is TRUE, indicating that the current frame is active, then a hangover count is stored to the variable hangover_1 and the set of instructions terminates. In this particular example, the hangover count is five, although any other positive integer value may be used. When the value of FRAME_ACTIVE becomes FALSE, indicating that the current frame is inactive, each subsequent iteration of the set of instructions decrements the value of the variable hangover_1 and terminates early until the value of the variable hangover 1 reaches zero. In this example, tasks T400 and T500 are implemented using instructions as described above with reference to FIG. 8B.

Examples of method M100 and apparatus A100 include implementations configured to control updating of the spectral tilt contour according to the state of an update control signal. Such a signal may be based on a voice activity indication as described above. The variable FRAME_ACTIVE shown in FIG. 14 is one example of an update control signal (specifically, an update disable signal). A hangover logic circuit 50 may be used to calculate an update control signal by delaying an active-to-inactive transition in the voice activity indication. FIG. 15 shows an implementation 52 of hangover logic circuit 50 that is configured to generate an update control signal (specifically, an update enable signal). In this figure, the state of the voice activity indication is low for an inactive frame and high for an active frame, a tapped delay line having three delay elements is used to implement a hangover of three frames, and a logical NOR operation is used to combine the current and delayed voice activity indications. In other examples, the state of the voice activity indication may be high for an inactive frame and low for an active frame, and in this case the current and delayed voice activity indications may be combined using a logical AND operation. As for the tapped delay line, other examples of this circuit may use any number of delay elements according to the desired duration of the hangover. Alternatively, a hangover logic circuit 50 may be implemented to use a delay counter to count down (or up) from an active-to-inactive transition and/or to calculate an update disable signal instead of an update enable signal.

Figure 16A:
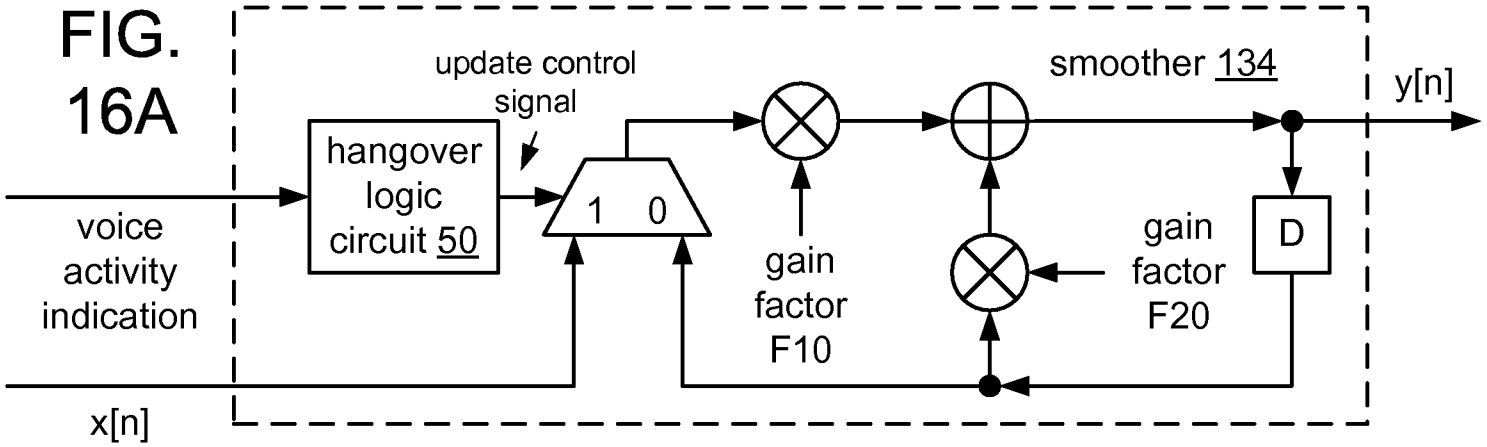
FIG. 16A shows a block diagram of an implementation 134 of smoother 132.

Sequence generator 120 may be configured to generate one or more values of the generated sequence of spectral tilt values according to a distance in time between the corresponding inactive frame and the preceding active frame. For example, sequence generator 120 or smoother 130 may be configured to suspend the start of updating of the spectral tilt contour after an active-to-inactive transition according to a desired hangover. Such an implementation of sequence generator 120 or smoother 130 may be configured to include an implementation of hangover logic circuit 50 as described above. FIG. 16A shows one such implementation 134 of smoother 132. In this example, a selector (e.g., a multiplexer) switches the input of the smoother between the current value of the sequence (i.e., x[n]) and the previous value of the smoothed spectral tilt contour (i.e., y[n−1]) according to the state of the update control signal. Alternatively, an implementation of smoother 110 may be configured to store the current value of x[n] when the update control signal is high, and to use this stored value for input when the update control signal is low.

Figure 16B:
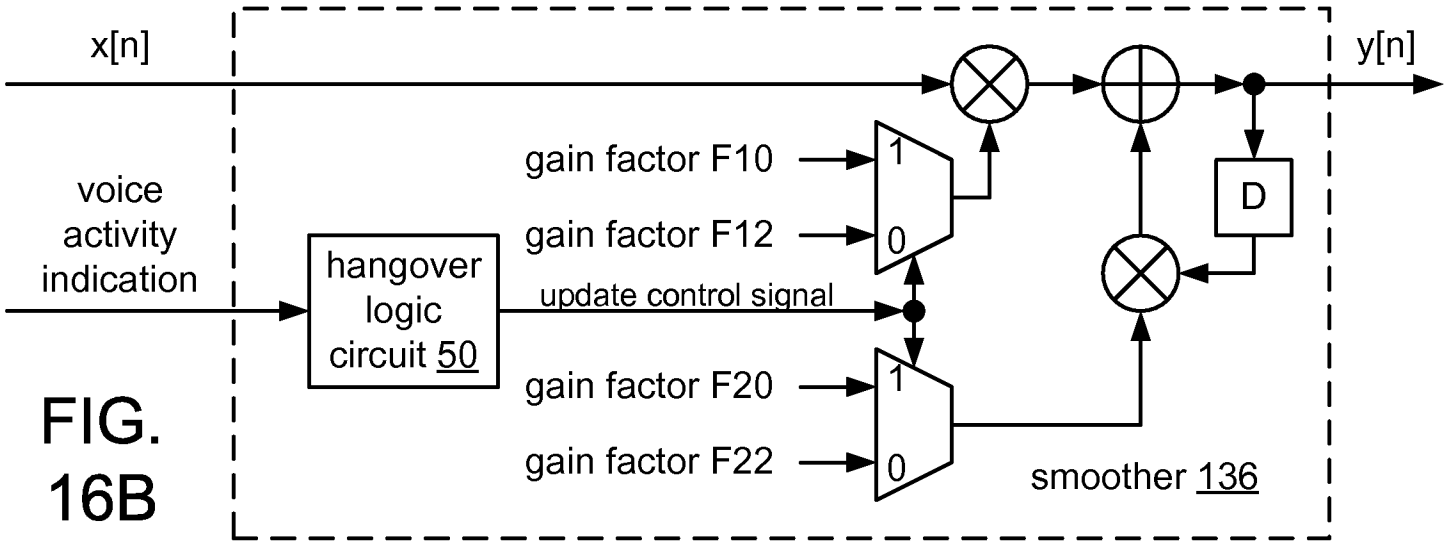
FIG. 16B shows a block diagram of an implementation 136 of smoother 132.

FIG. 16B shows another implementation 136 of smoother 132 that includes an implementation of hangover logic circuit 50 as described above. This example includes two selectors (e.g., multiplexers) that are configured to output different gain factors according to the state of the update control signal. The first selector outputs the gain factor to be applied to x[n]. When the state of the update control signal is high, this selector outputs the gain factor F10, and when the state of the update control signal is low, this selector outputs the gain factor F12. The second selector outputs the gain factor to be applied to y[n−1]. When the state of the update control signal is high, this selector outputs the gain factor F20, and when the state of the update control signal is low, this selector outputs the gain factor F22. In one example, the gain factors F10 and F12 have the values 0.2 and 0, respectively, and the gain factors F20 and F22 have the values 0.8 and 1.0, respectively.

A further implementation of smoother 136 may be configured to select between more than two values for each gain factor, such that the transition from suspended to normal operation of the smoother is more gradual. In place of a hangover logic circuit that generates a binary control signal, for example, such a smoother may include an implementation of hangover logic circuit 50 that is configured to generate a control signal having more than two states. Such an example of hangover logic circuit 50 may be configured to generate an update control signal that passes through c states in response to an active-to-inactive transition, where c is an integer greater than two. In such case, the two selectors of smoother 136 may be configured such that, in response to the transition and over a series of c frames, the gain factor applied to x[n] passes through c values from minimum to maximum (e.g., from 0.0 to 0.2) while the gain factor applied to y[n−1] passes through c values from maximum to minimum (e.g., from 1.0 to 0.8).

A measure of coding gain describes a relation between the energy of a signal as received by a speech encoder (or method of speech encoding) and the energy of a corresponding coding error. Typically a speech encoder or method of speech encoding will code active frames more efficiently than inactive frames, such that the measure of coding gain will be higher for active frames than for inactive frames. One example of a measure of coding gain for a frame is the ratio of the initial signal energy $E_{in}$ (e.g., the energy of the windowed frame) to the energy of the coding residual $E_{err}$. In such cases, the energy of each signal is typically calculated as the sum of the magnitudes of the samples. Another common measure of coding gain for LPC analysis is the prediction gain, which may be calculated as the reciprocal of the product of $(1-k_i^2)$ for all i≤j (alternatively, for all i, 1<i≤j), where j is the order of the LPC analysis and $k_i$ indicates the i-th reflection coefficient.

The degree of coding gain achieved by a speech encoder or method of speech encoding tends to vary from frame to frame as the statistics of the signal change. During a series of inactive frames, however, it may be expected that the signal will be relatively stationary such that its statistics will not vary significantly. Thus the value $G_c$ of a measure of coding gain may be expected to remain relatively constant even during perceptually significant changes in the background noise.

A large change in the value $G_c$ of a measure of coding gain may indicate that the speech signal has changed due to a factor other than a change in the background noise. One factor which may cause such a change in the value $G_c$ is voice activity that is below the detection threshold of the encoder's voice activity detector. In such case, a large change may also occur in the spectral tilt value, leading to a positive SID transmit decision by task T500, even if the background noise has not changed significantly.

It may be desirable to implement method M100 to account for changes in spectral tilt that are associated with changes in the value $G_c$ of a measure of coding gain. For example, an implementation T230 of task T200 or an implementation T330 of task T300 may be configured to enable or disable contour updating based on the magnitude of a variation in the value $G_c$ of a measure of coding gain.

In some cases, the measure of coding gain may be calculated in terms of a coding error, as in an expression such as $$G_c = \frac{E_{err}}{E_{in}}.$$

Likewise, the prediction gain may be calculated as a prediction error, as in an expression such as $$G_c = \prod_i (1 - k_i^2)$$

for all i≤j (alternatively, for all 1≤i≤j).

The measure of coding gain may also be calculated according to other expressions that, for example, also include the product $$\prod_i (1 - k_i^2)$$

for all i≤j (alternatively, for all 1≤i≤j),
or a ratio between $E_{in}$ and $E_{err}$, as a factor or term.

The measure of coding gain may be expressed on a linear scale or in another domain, such as on a logarithmic scale. Examples of such expressions include the following:

$$\log\frac{E_{in}}{E_{err}}, \log\frac{E_{err}}{E_{in}}, \log\prod_i (1 - k_i^2), \log\prod_i \frac{1}{(1 - k_i^2)}.$$

The measure of coding gain is typically evaluated for each frame, but may also be evaluated less frequently (e.g., for every second or third frame) and/or over a longer interval (e.g., over a pair or triplet of frames).

In a typical arrangement, task T230 or T330 is configured to disable updating of the generated spectral tilt contour when the value $G_c$ changes by more than a threshold amount (alternatively, by not less than a threshold amount) from one inactive frame to the next. In one particular example, task T330 is configured to disable updating of the smoothed contour when the value of the prediction gain changes by more than 0.72 dB from the previous inactive frame to the current inactive frame. An implementation of task T230 or task T330 may be configured to apply a hangover to extend such disabling to one or more subsequent frames. A further implementation of task T230 or task T330 may also be configured to apply a hangover following a transition from active speech as described above (e.g., with reference to FIGS. 13A-16B).

Figure 17A:
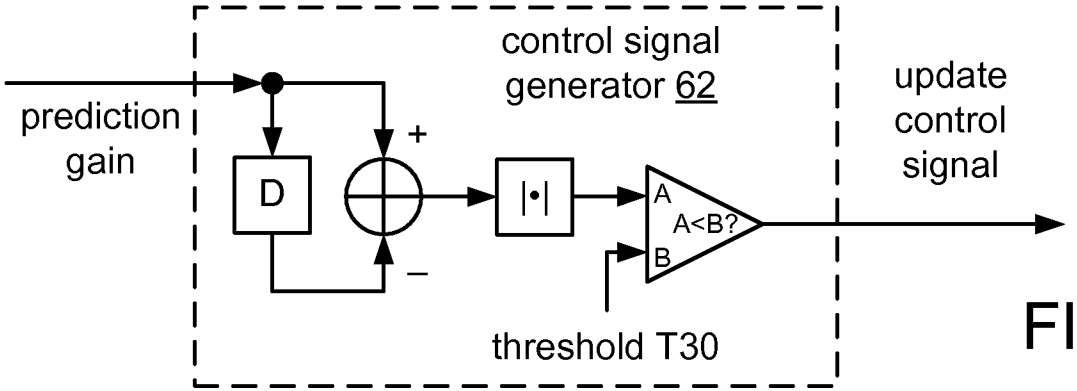
FIG. 17A shows a block diagram of one example 62 of a control signal generator 60 configured to generate an update control signal based on a prediction gain.
Figure 17B:
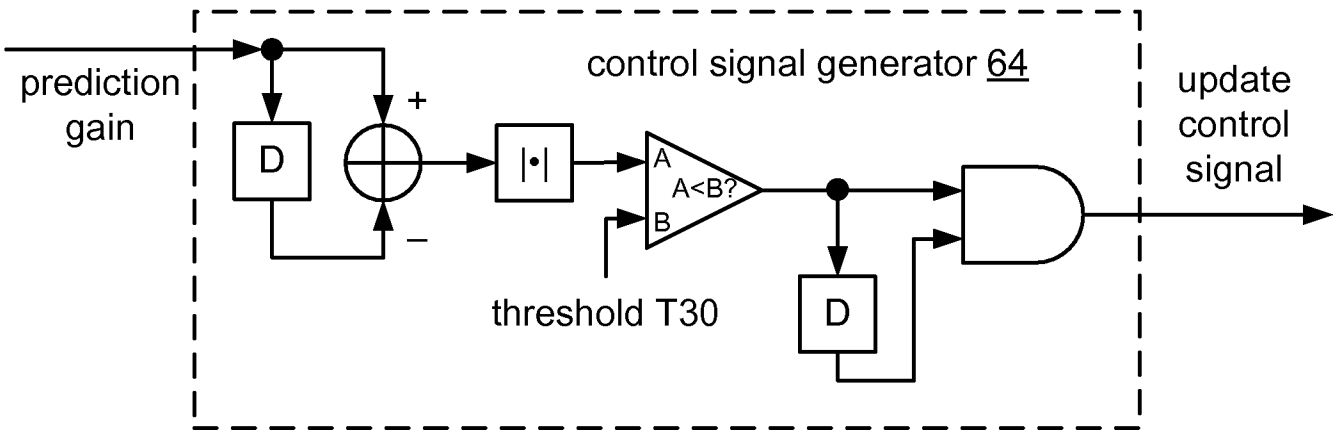
FIG. 17B shows a block diagram of one example 64 of control signal generator 62 that is configured to apply a hangover.
Figure 18:
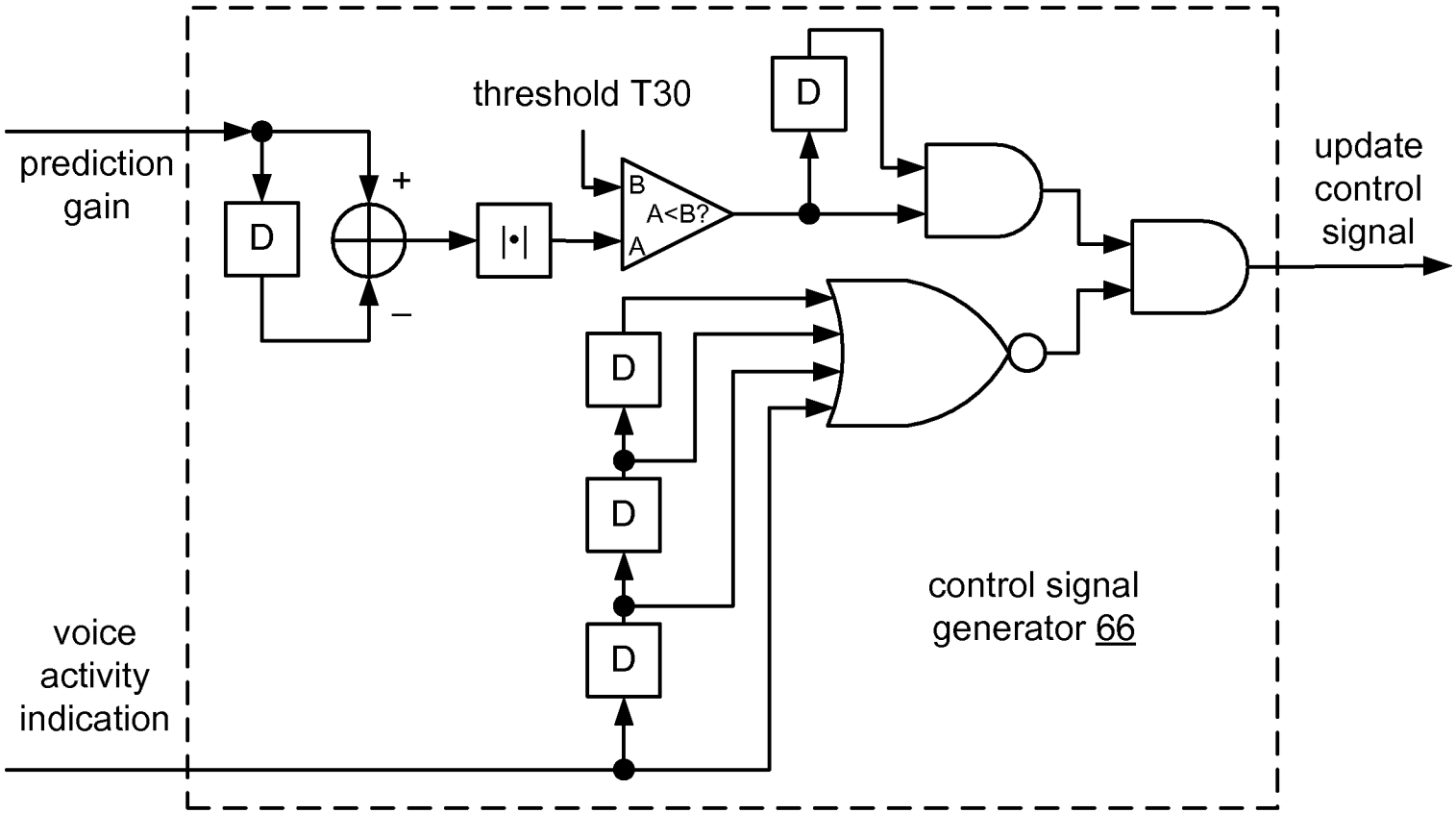
FIG. 18 shows a block diagram of an implementation 66 of control signal generator 64 that also includes hangover logic circuit 52.

It may be desirable to implement apparatus A100 to account for changes in a spectral tilt contour that are associated with changes in the value $G_c$ of a measure of coding gain (such as one of the examples described above). For example, apparatus A100 may be implemented to include a control signal generator 60 configured to generate an update control signal whose state is based on the magnitude of a variation in the prediction gain. FIG. 17A shows a block diagram of one example 62 of control signal generator 60. Control signal generator 60 may also be implemented to apply a hangover, as in the example of control signal generator 64 shown in FIG. 17B. In one particular example, the value of threshold T30 is 0.72 dB. An implementation of smoother 134 or 136 may include an implementation of control signal generator 60 in place of, or in addition to, a circuit that is configured to delay an active-to-inactive transition in a voice activity indication. For example, such an implementation may include a control signal generator 66 as shown in FIG. 18, which combines the operations of hangover logic circuit 62 and control signal generator 64.

An implementation of method M100 may be configured to control generation of a SID transmit indication according to a change in the value of a measure of coding gain. For example, an implementation of method M100 may include an implementation of task T400 that is configured to output a distance of zero if the value of the measure of coding gain (e.g., the prediction gain) changes by more than a threshold amount (alternatively, by not less than a threshold amount) from one inactive frame to the next. Additionally or in the alternative, an implementation of method M100 may include an implementation of task T500 that is configured to enable or disable generation of a positive SID transmit indication according to the magnitude of a variation in the prediction gain. One such implementation T510 of task T500 is configured to disable generation of a positive SID transmit indication unless the prediction gain changes by less than (alternatively, by not more than) a threshold value from the previous inactive frame to the current inactive frame. In one such particular example, the threshold value is 0.65 dB. Control of generation of the transmit indication may be performed in addition to or as an alternative to controlling updating of a spectral tilt contour.

Figure 19A:
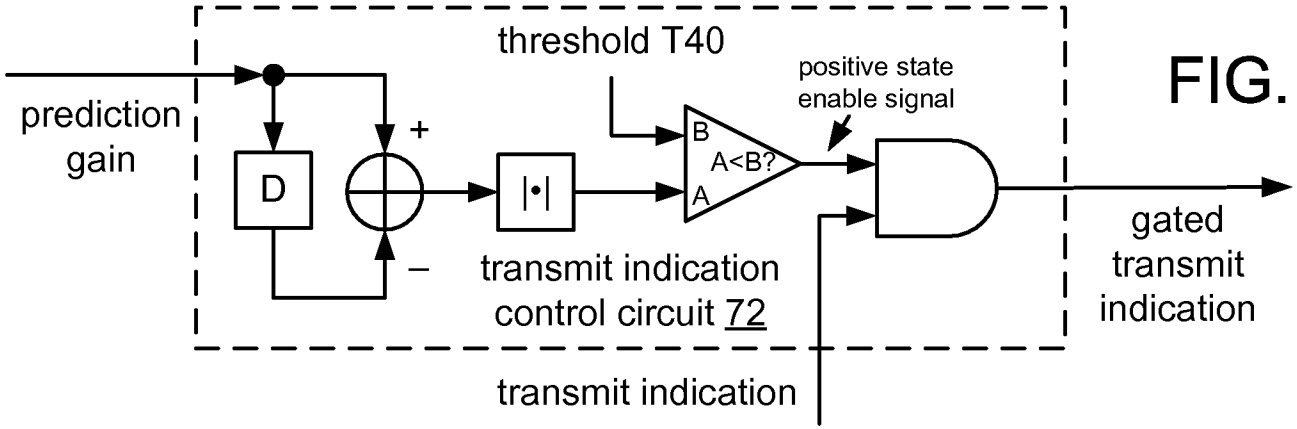
FIG. 19A shows a block diagram of one example 72 of transmit indication control circuit 70.
Figure 19B:
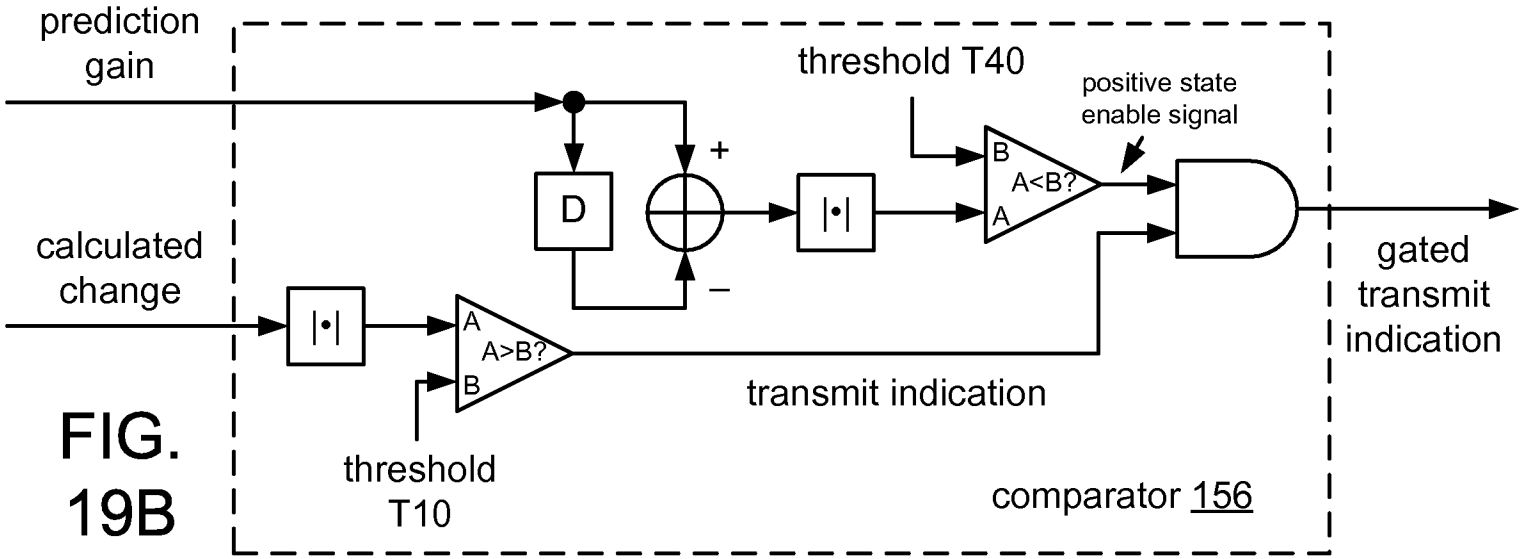
FIG. 19B shows a block diagram of an implementation 156 of comparator 152.

An implementation of apparatus A100 may be configured to control generation of the SID transmit indication according to a change in the value $G_c$ of a measure of the coding gain. FIG. 19A shows a block diagram of one example 72 of a transmit indication control circuit 70 that is configured to gate a positive SID transmit indication according to a relation between a threshold T40 and the magnitude of a change in the prediction gain. In one particular example, the value of threshold T40 is 0.65 dB. FIG. 19B shows a block diagram of an implementation 156 of comparator 152 that includes transmit indication control circuit 72.

Figure 20:
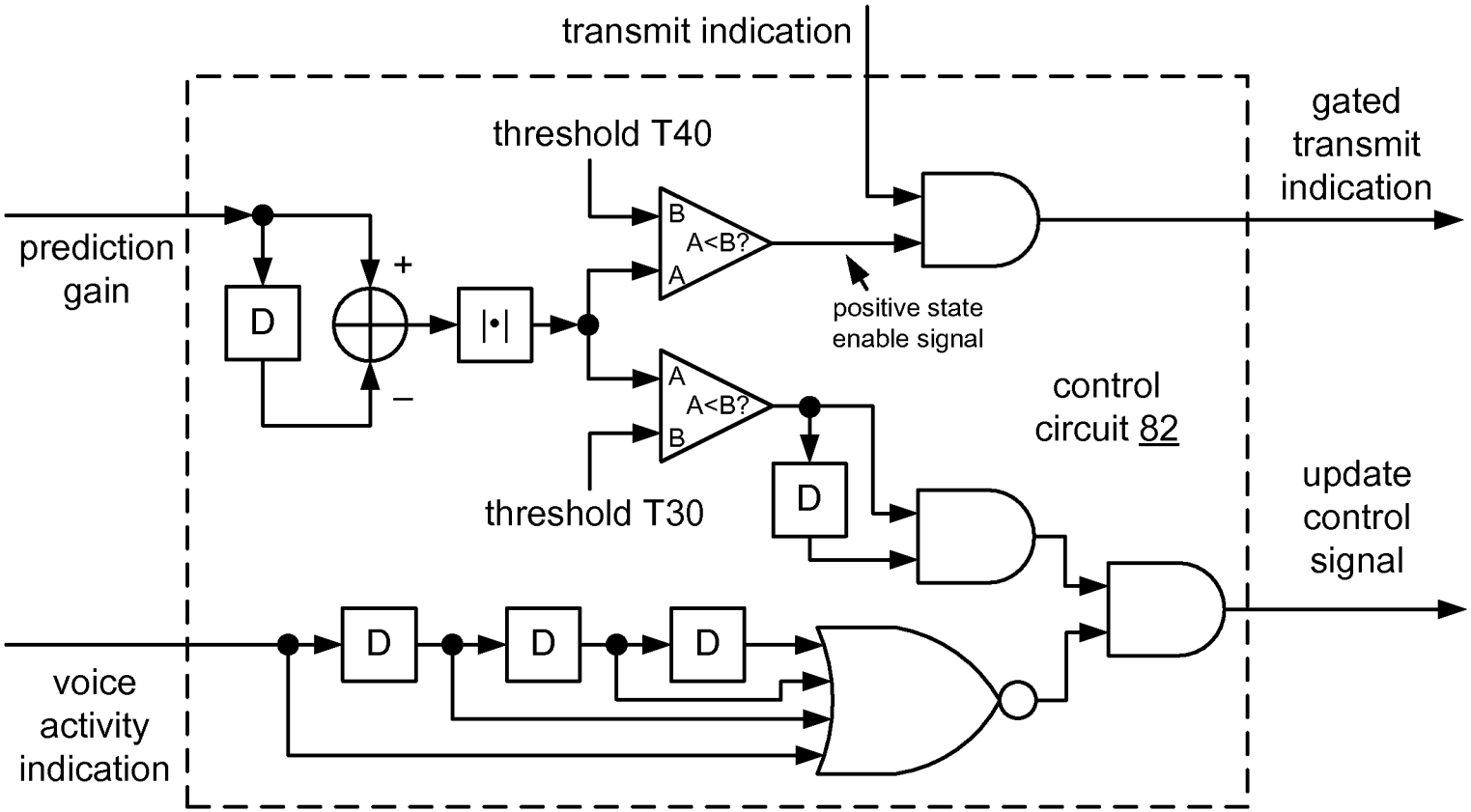
FIG. 20 shows a block diagram of one example 82 of a control circuit 80 configured to generate an update control signal and to gate a SID transmit indication.

An implementation of apparatus A100 may be configured to control the generation of both an update control signal and a SID transmit indication, based on a change in the value $G_c$ of a measure of the coding gain. FIG. 20 shows a block diagram of one example 82 of a control circuit 80 configured to perform these operations. Such a circuit may be arranged to receive a SID transmit indication from comparator 150 and to provide an update control signal to smoother 130. Such a circuit may also be implemented within smoother 130 or comparator 150. In smoother 134 or 136, for example, control circuit 82 may be arranged to replace hangover logic circuit 52 and to gate a SID transmit indication from comparator 150 according to the prediction gain. In another example, control circuit 82 may be arranged within comparator 152 to gate the SID transmit indication according to the prediction gain and also to provide an update control signal to smoother 130.

FIG. 21 shows one example of a source code listing for a set of instructions that may be executed by a programmable array of logic elements or other state machine (e.g., a processor) to perform an implementation of method M100 that includes an implementation T332 of tasks T312 and T330, an implementation T510 of task T500, and an implementation of task T400. In this example, the state of the variable FRAME_ACTIVE indicates whether the current frame is active or inactive, the state of the variable Y_VALID indicates whether the set of instructions has been called before (and thus whether the value stored in the variable y_current is valid), and the value of the variable Gc indicates the prediction gain for the current frame.

If the set of instructions determines that the value of Y_VALID is FALSE (i.e., if the set of instructions is executing for the first time), then the variable Gc_current is initialized to the current value of the variable Gc. The absolute difference between the current and past values of Gc is stored to the variable Gc_diff, and if this difference is greater than a threshold value, a hangover of two frames is applied. In Part 3, the flag p is set only if the value of Gc_diff is less than a threshold value.

The particular examples of logical implementations described herein are presented to explain the disclosure and not to limit it, and those of skill in the art will readily understand that alternate logical implementations are included within the scope of this disclosure. For example, selection logic implemented in one context as an AND gate arranged to produce an active high signal only when all of its inputs are high may be implemented in another context as an OR gate arranged to produce an active low signal only when all of its inputs are low. A countdown from a first value to a second value may also be implemented as a countup from the second value to the first value, and vice versa. A positive or TRUE indication may be expressed using a binary high value in one context and a binary low value in another context. It is contemplated and hereby disclosed that these and other implementational equivalences are included within the scope of this disclosure.

In the examples discussed above, it is assumed that the sequence of spectral tilt values includes a value for each in a series of consecutive inactive frames. However, it is also contemplated that method M100 and apparatus A100 may be implemented such that the sequence of spectral tilt values includes fewer than one value for each in a series of consecutive inactive frames. For example, the sequence may include a value for every other frame (or every third frame, etc.) in the series. Such a sequence may be obtained by ignoring intermediate frames or discarding values from such frames, or by averaging the values of each pair (triplet, etc.) of frames. Alternatively or additionally, such principles may be applied to other sequences, such as a sequence of values of a measure of coding gain.

Those of skill in the art will understand that information and signals may be represented using any of a variety of different technologies and techniques. For example, data, instructions, commands, information, signals, bits, and symbols that may be referenced throughout the above description may be represented by voltages, currents, electromagnetic waves, magnetic fields or particles, optical fields or particles, or any combination thereof. Although the signal from which the generated sequence of spectral tilt values is derived is called a "speech signal," it is also contemplated and hereby disclosed that this signal may carry music or other non-speech information content during active frames.

The elements of the various implementations of apparatus 100 as described herein may be fabricated as electronic and/or optical devices residing, for example, on the same chip or among two or more chips in a chipset. One example of such a device is a fixed or programmable array of logic elements, such as transistors or gates. One or more elements of the various implementations of apparatus 100 as described herein may also be implemented in whole or in part as one or more sets of instructions arranged to execute on one or more fixed or programmable arrays of logic elements such as microprocessors, embedded processors, IP cores, digital signal processors, FPGAs (field-programmable gate arrays), ASSPs (application-specific standard products), and ASICs (application-specific integrated circuits).

It is possible for one or more elements of an implementation of apparatus 100 to be used to perform tasks or execute other sets of instructions that are not directly related to an operation of the apparatus, such as a task relating to another operation of a device or system in which the apparatus is embedded. It is also possible for one or more elements of an implementation of apparatus A100 to have structure in common (e.g., a processor used to execute portions of code corresponding to different elements at different times, a set of instructions executed to perform tasks corresponding to different elements at different times, or an arrangement of electronic and/or optical devices performing operations for different elements at different times). In one such example, smoother 130, calculator 140, and comparator 150 are implemented as sets of instructions arranged to execute on the same processor. In another such example, sequence generator 120 or even a speech encoder (which may include apparatus A100) is implemented as one or more sets of instructions arranged to execute on that processor.

The foregoing presentation of the described configurations is provided to enable any person skilled in the art to make or use the methods and other structures disclosed herein. The flowcharts and other structures shown and described herein are examples only, and other variants of these structures are also within the scope of the disclosure. Various modifications to these configurations are possible, and the generic principles presented herein may be applied to other configurations as well.

The configurations described herein may be implemented in part or in whole as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a microprocessor or other digital signal processing unit. The data storage medium may be an array of storage elements such as semiconductor memory (which may include without limitation dynamic or static RAM (random-access memory), ROM (read-only memory), and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

The methods disclosed herein may also be tangibly embodied (for example, in one or more data storage media as listed above) as one or more sets of instructions readable and/or executable by a machine including an array of logic elements (e.g., a processor, microprocessor, microcontroller, or other finite state machine). Thus, the present disclosure is not intended to be limited to the configurations shown above but rather is to be accorded the widest scope consistent with the principles and novel features disclosed in any fashion herein, including in the attached claims as filed, which form a part of the original disclosure.

Those of skill would further appreciate that the various illustrative logical blocks, modules, circuits, and operations described in connection with the configurations disclosed herein may be implemented as electronic hardware, computer software, or combinations of both. Such logical blocks, modules, circuits, and operations may be implemented or performed with a general purpose processor, a digital signal processor (DSP), an ASIC, an FPGA or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The tasks of the methods and algorithms described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

What is claimed is:

1. A method of processing a speech signal, said method comprising:

generating, by a sequence generator of a computer, a sequence of spectral tilt values that is based on a plurality of inactive frames of the speech signal, wherein the sequence of spectral tilt values comprises a sequence of reflection coefficients, wherein each of the spectral tilt values is based on at least one reflection coefficient of a corresponding inactive frame of the speech signal, the at least one reflection coefficient comprising at least one of a first reflection coefficient of the corresponding inactive frame or a second reflection coefficient of the corresponding inactive frame;

calculating, by a calculator of the computer, a change among at least two of the reflection coefficient-based spectral tilt values; and for an inactive frame among the plurality of inactive frames, deciding, by a comparator of the computer, whether to transmit a description for the frame, wherein said deciding whether to transmit a description for the frame is based on the calculated change.

2. The method of processing a speech signal according to claim 1, wherein said generating a sequence of spectral tilt values comprises smoothing another sequence of spectral tilt values to generate the sequence of spectral tilt values, wherein each of the spectral tilt values of the other sequence indicates a spectral tilt of a corresponding one of the plurality of inactive frames.

3. The method of processing a speech signal according to claim 1, wherein each of a plurality of the spectral tilt values is based on at least another spectral tilt value in the sequence of spectral tilt values.

4. The method of processing a speech signal according to claim 1, wherein each of a plurality of the spectral tilt values is based on (A) a spectral tilt of a corresponding one of the plurality of inactive frames and (B) at least another spectral tilt value in the sequence of spectral tilt values.

5. The method of processing a speech signal according to claim 1, wherein the calculated change is based on a difference between consecutive values in the sequence of spectral tilt values.

6. The method of processing a speech signal according to claim 1, wherein said calculating a change comprises calculating a distance between adjacent values in the sequence of spectral tilt values.

7. The method of processing a speech signal according to claim 1, wherein said deciding whether to transmit a description for the frame comprises comparing the calculated change to a threshold value.

8. The method of processing a speech signal according to claim 1, wherein an outcome of said deciding whether to transmit a description for the frame is based on a relation between (A) a magnitude of the calculated change and (B) a threshold value.

9. The method of processing a speech signal according to claim 1, wherein said method comprises, if an outcome of said deciding whether to transmit a description for the frame is a decision to transmit a description for the frame, transmitting a silence description that includes at least one of a spectral envelope description and an energy envelope description.

10. The method of processing a speech signal according to claim 9, wherein said method comprises calculating the silence description based on at least one among (A) spectral envelope descriptions of each of a plurality of inactive frames and (B) energy envelope descriptions of each of a plurality of inactive frames.

11. The method of processing a speech signal according to claim 1, wherein said deciding whether to transmit a description for the frame is based on at least one among (A) a vector describing a spectral envelope of the frame, (B) a residual energy of the frame, (C) a distance in time to a most recent transmission of a description for an inactive frame, (D) a distance in time to a most recent active frame, (E) a description of an energy envelope of the frame, (F) a mean absolute value of the frame, and (G) an energy value of the frame.

12. The method of processing a speech signal according to claim 11, wherein said method comprises, if an outcome of said deciding whether to transmit a description for the frame is a decision to transmit a description for the frame, transmitting a silence description that includes at least one of a spectral envelope description and an energy envelope description.

13. The method of processing a speech signal according to claim 1, wherein said deciding whether to transmit a description for the frame comprises, in response to detecting that a change in a measure of coding gain exceeds a threshold value, deciding not to transmit a description for the frame.

14. The method of processing a speech signal according to claim 13, wherein each value of the measure of coding gain is based on the values of a plurality of reflection coefficients of a corresponding inactive frame of the speech signal.

15. The method of processing a speech signal according to claim 1, wherein said method comprises calculating, for each of a plurality of the spectral tilt values in the sequence of spectral tilt values, a change among the spectral tilt value and at least one other spectral tilt value in the sequence of spectral tilt values, and wherein said method comprises, for each of another plurality of inactive frames of the speech signal, deciding whether to transmit a description for the frame, and wherein, for each of the other plurality of inactive frames, an outcome of said deciding whether to transmit a description for the frame is based on at least one of the calculated changes.

16. The method of processing a speech signal according to claim 15, wherein, for at least some of the other plurality of inactive frames, an outcome of said deciding whether to transmit a description for the frame is a decision not to transmit a description for the frame.

17. The method of processing a speech signal according to claim 15, wherein, for each of the other plurality of inactive frames, said deciding whether to transmit a description for the frame comprises, in response to detecting that a change in a measure of coding gain exceeds a threshold value, deciding not to transmit a description for the frame.

18. The method of processing a speech signal according to claim 17, wherein, for each of the other plurality of inactive frames, said change in a measure of coding gain is based on (A) a value for the measure of coding gain for a first inactive frame of the speech signal that precedes the frame and (B) a value for the measure of coding gain for a second inactive frame of the speech signal that precedes the frame and is different from the first inactive frame.

19. The method of processing a speech signal according to claim 1, wherein said generating a sequence of spectral tilt values comprises, for at least some of the plurality of inactive frames, generating a corresponding spectral tilt value among the sequence of spectral tilt values according to a distance in time between the inactive frame and a preceding active frame of the speech signal.

20. The method of processing a speech signal according to claim 19, wherein said generating a corresponding spectral tilt value among the sequence of spectral tilt values comprises setting the spectral tilt value to a previous spectral tilt value among the sequence of spectral tilt values when the distance in time between the inactive frame and a preceding active frame of the speech signal is less than a threshold value.

21. The method of processing a speech signal according to claim 1, wherein said generating a sequence of spectral tilt values comprises, for at least some of the plurality of inactive frames, calculating a corresponding spectral tilt value among the sequence of spectral tilt values according to a measure of coding gain for the inactive frame.

22. The method of processing a speech signal according to claim 1, wherein said generating a sequence of spectral tilt values comprises, for at least one of the sequence of spectral tilt values, setting the spectral tilt value to a previous spectral tilt value among the sequence of spectral tilt values in response to detecting that a change in a measure of coding gain exceeds a threshold value.

23. The method of claim 1, further comprising:

combining multiple transmit indications into a composite transmit indication, wherein each transmit indication is produced from a different blanking algorithm; and determining whether to transmit a description of an inactive frame based on the composite transmit indication.

24. A non-transitory computer-readable medium, said medium comprising instructions that when executed cause at least one computer to:

generate a sequence of spectral tilt values that is based on a plurality of inactive frames of a speech signal, wherein the sequence of spectral tilt values comprises a sequence of reflection coefficients, wherein each of the spectral tilt values is based on at least one reflection coefficient of a corresponding inactive frame of the speech signal, the at least one reflection coefficient comprising at least one of a first reflection coefficient of the corresponding inactive frame or a second reflection coefficient of the corresponding inactive frame;

calculate a change among at least two of the reflection coefficient-based spectral tilt values; and decide, for an inactive frame among the plurality of inactive frames, and based on the calculated change, whether to transmit a description for the frame.

25. The computer-readable medium according to claim 24, wherein said instructions for causing at least one computer to generate a sequence of spectral tilt values are configured to cause the at least one computer to generate each of a plurality of the spectral tilt values based on at least another spectral tilt value in the sequence of spectral tilt values.

26. The computer-readable medium according to claim 24, wherein said instructions for causing at least one computer to calculate a change are configured to cause the at least one computer to calculate the change based on a difference between consecutive values in the sequence of spectral tilt values.

27. The computer-readable medium according to claim 24, wherein said instructions for causing at least one computer to decide whether to transmit a description for the frame are configured to cause the at least one computer to decide whether to transmit a description for the frame based on a relation between (A) a magnitude of the calculated change and (B) a threshold value.

28. The computer-readable medium according to claim 24, wherein said instructions for causing at least one computer to decide whether to transmit a description for the frame include instructions for causing the at least one computer to decide, in response to a change in a measure of coding gain that exceeds a threshold value, not to transmit a description for the frame.

29. The computer-readable medium according to claim 24, wherein said instructions for causing at least one computer to calculate a change are configured to cause the at least one computer to calculate, for each of a plurality of the spectral tilt values in the sequence of spectral tilt values, a change among the spectral tilt value and at least one other spectral tilt value in the sequence of spectral tilt values, and wherein said instructions for causing at least one computer to decide whether to transmit a description for the frame are configured to cause the at least one computer to decide, for each of another plurality of inactive frames of the speech signal, whether to transmit a description for the frame, and wherein said instructions for causing at least one computer to decide whether to transmit a description for the frame are configured such that, for each of the other plurality of inactive frames, the decision whether to transmit a description for the frame is based on at least one of the calculated changes.

30. The computer-readable medium according to claim 24, wherein said instructions for causing at least one computer to generate a sequence of spectral tilt values comprise instructions for causing the at least one computer to generate, for at least some of the plurality of inactive frames, a corresponding spectral tilt value among the sequence of spectral tilt values according to a distance in time between the inactive frame and a preceding active frame of the speech signal.

31. The computer-readable medium according to claim 24, wherein said instructions for causing at least one computer to generate a sequence of spectral tilt values are configured to cause the at least one computer, for at least one of the sequence of spectral tilt values, to set the spectral tilt value to a previous spectral tilt value among the sequence of spectral tilt values in response to detecting that a change in a measure of coding gain exceeds a threshold value.

32. The computer-readable medium according to claim 24, wherein said instructions for causing at least one computer to generate a sequence of spectral tilt values are configured to cause the at least one computer to smooth another sequence of spectral tilt values to generate the sequence of spectral tilt values, wherein each of the spectral tilt values of the other sequence indicates a spectral tilt of a corresponding one of the plurality of inactive frames.

33. An apparatus for processing a speech signal, said apparatus comprising:

a sequence generator configured to generate a sequence of spectral tilt values that is based on a plurality of inactive frames of the speech signal, wherein the sequence of spectral tilt values comprises a sequence of reflection coefficients, wherein each of the spectral tilt values is based on at least one reflection coefficient of a corresponding inactive frame of the speech signal, the at least one reflection coefficient comprising at least one of a first reflection coefficient of the corresponding inactive frame or a second reflection coefficient of the corresponding inactive frame;

a calculator configured to calculate a change among at least two of the reflection coefficient-based spectral tilt values; and a comparator configured to decide, for an inactive frame among the plurality of inactive frames, and based on the calculated change, whether to transmit a description for the frame.

34. The apparatus for processing a speech signal according to claim 33, wherein said comparator is configured to decide whether to transmit a description for the frame based on a relation between (A) a magnitude of the calculated change and (B) a threshold value.

35. The apparatus for processing a speech signal according to claim 33, wherein the apparatus comprises a device for wireless communications that includes said sequence generator, said calculator, and said comparator, and wherein said device is configured to transmit, in response to a decision by said comparator to transmit a description for the frame, a silence description that includes at least one of a spectral envelope description and an energy envelope description.

36. The apparatus for processing a speech signal according to claim 33, wherein said comparator is configured to decide, in response to a change in a measure of coding gain that exceeds a threshold value, not to transmit a description for the frame.

37. The apparatus for processing a speech signal according to claim 33, wherein said calculator is configured to calculate, for each of a plurality of the spectral tilt values in the sequence of spectral tilt values, a change among the spectral tilt value and at least one other spectral tilt value in the sequence of spectral tilt values, and wherein said comparator is configured to decide, for each of another plurality of inactive frames of the speech signal, whether to transmit a description for the frame, and wherein said comparator is configured such that, for each of the other plurality of inactive frames, the decision whether to transmit a description for the frame is based on at least one of the calculated changes.

38. The apparatus for processing a speech signal according to claim 33, wherein said sequence generator is configured to generate, for at least some of the plurality of inactive frames, a corresponding spectral tilt value among the sequence of spectral tilt values according to a distance in time between the inactive frame and a preceding active frame of the speech signal.

39. The apparatus for processing a speech signal according to claim 33, wherein said sequence generator is configured, for at least one of the sequence of spectral tilt values, to set the spectral tilt value to a previous spectral tilt value among the sequence of spectral tilt values in response to detecting that a change in a measure of coding gain exceeds a threshold value.

40. The apparatus for processing a speech signal according to claim 33, wherein said sequence generator is configured to generate the sequence of spectral tilt values by smoothing another sequence of spectral tilt values, wherein each of the spectral tilt values of the other sequence indicates a spectral tilt of a corresponding one of the plurality of inactive frames.

41. An apparatus for processing a speech signal, said apparatus comprising:

means for generating a sequence of spectral tilt values that is based on a plurality of inactive frames of the speech signal, wherein the sequence of spectral tilt values comprises a sequence of reflection coefficients, wherein each of the spectral tilt values is based on at least one reflection coefficient of a corresponding inactive frame of the speech signal, the at least one reflection coefficient comprising at least one of a first reflection coefficient of the corresponding inactive frame or a second reflection coefficient of the corresponding inactive frame;

means for calculating a change among at least two of the reflection coefficient-based spectral tilt values; and means for deciding, for an inactive frame among the plurality of inactive frames, and based on the calculated change, whether to transmit a description for the frame.

42. The apparatus for processing a speech signal according to claim 41, wherein said apparatus comprises means for transmitting, in response to a decision by said means for deciding to transmit a description for the frame, a silence description that includes at least one of a spectral envelope description and an energy envelope description.

43. The apparatus for processing a speech signal according to claim 41, wherein said means for generating a sequence of spectral tilt values is configured to generate, for at least some of the plurality of inactive frames, a corresponding spectral tilt value among the sequence of spectral tilt values according to a distance in time between the inactive frame and a preceding active frame of the speech signal.

44. The apparatus for processing a speech signal according to claim 41, wherein said means for generating a sequence of spectral tilt values is configured, for at least one of the sequence of spectral tilt values, to set the spectral tilt value to a previous spectral tilt value among the sequence of spectral tilt values in response to detecting that a change in a measure of coding gain exceeds a threshold value.

45. The apparatus for processing a speech signal according to claim 41, wherein said means for generating a sequence of spectral tilt values is configured to generate the sequence of spectral tilt values by smoothing another sequence of spectral tilt values, wherein each of the spectral tilt values of the other sequence indicates a spectral tilt of a corresponding one of the plurality of inactive frames.

46. A method of processing a speech signal, said method comprising:

generating, by a sequence generator of a computer, a sequence of spectral tilt values that is based on a plurality of inactive frames of the speech signal, wherein the sequence of spectral tilt values comprises a sequence of reflection coefficients, wherein each of the spectral tilt values is based on at least one reflection coefficient of a corresponding inactive frame of the speech signal, the at least one reflection coefficient comprising at least one of a first reflection coefficient of the corresponding inactive frame or a second reflection coefficient of the corresponding inactive frame;

calculating, by a calculator of the computer, a change among at least two of the reflection coefficient-based spectral tilt values; and for an inactive frame among the plurality of inactive frames, deciding, by a comparator of the computer, whether to transmit a description for the frame, wherein said deciding whether to transmit a description for the frame is based on the calculated change, and wherein said generating a sequence of spectral tilt values comprises, for at least some of the plurality of inactive frames, generating a corresponding spectral tilt value among the sequence of spectral tilt values according to a distance in time between the inactive frame and a preceding active frame of the speech signal.

* * * * *